US007176844B2

(12) United States Patent
Chiang et al.

(10) Patent No.: US 7,176,844 B2
(45) **Date of Patent: *Feb. 13, 2007**

(54) APERIODIC ARRAY ANTENNA

(75) Inventors: Bing Chiang, Melbourne, FL (US); Griffin K. Gothard, Satellite Beach, FL (US); Christopher A. Snyder, Melbourne, FL (US); William R. Palmer, Melbourne, FL (US); Michael J. Lynch, Merritt Island, FL (US); Thomas E. Gorsuch, Indialantic, FL (US); Kenneth M. Gainey, Satellite Beach, FL (US); James A. Proctor, Jr., Melbourne Beach, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/102,984

(22) Filed: Apr. 11, 2005
(Under 37 CFR 1.47)

(65) Prior Publication Data

US 2005/0190115 A1 Sep. 1, 2005

Related U.S. Application Data

(63) Continuation of application No. 10/357,276, filed on Jan. 31, 2003, now Pat. No. 6,888,504.

(60) Provisional application No. 60/353,249, filed on Feb. 1, 2002, provisional application No. 60/419,431, filed on Oct. 17, 2002.

(51) Int. Cl.
*H01Q 11/10* (2006.01)

(52) U.S. Cl. ..... 343/815; 343/833

(58) Field of Classification Search ..... 343/815, 343/833, 834, 818
See application file for complete search history.

(56) References Cited

U.S. PATENT DOCUMENTS

| | | | | |
|---|---|---|---|---|
| 3,560,978 | A * | 2/1971 | Himmel et al. | 342/399 |
| 3,750,185 | A * | 7/1973 | Evans | 343/814 |
| 3,846,799 | A | 11/1974 | Gueguen | |
| 4,700,197 | A | 10/1987 | Milne | |
| 4,864,320 | A * | 9/1989 | Munson et al. | 343/833 |
| 4,992,799 | A | 2/1991 | Garay | |
| 5,235,343 | A | 8/1993 | Audren et al. | |
| 5,724,666 | A | 3/1998 | Dent | |
| 5,767,807 | A | 6/1998 | Pritchett | |

(Continued)

OTHER PUBLICATIONS

Ohira and Gyoda, "Electronically Steerable Passive Array Radiator Antennas for Low-Cost Analog Adaptive Beamforming,"0-7803-6345-0/00, 2000 IEEE.

(Continued)

*Primary Examiner*—Tho Phan
(74) *Attorney, Agent, or Firm*—Volpe and Koenig, P.C.

(57) ABSTRACT

An antenna array that uses at least two passive antennas and one active antenna disposed above a ground plane, but electrically isolated from the ground plane, and a respective resonant strip positioned beneath each passive antenna. The passive antenna elements are positioned about the active element, and each of the at least two passive antenna elements is individually set to a reflective or a transmissive mode to change the characteristics of an input/output beam pattern of the antenna apparatus.

16 Claims, 19 Drawing Sheets

U.S. PATENT DOCUMENTS

| | | | | |
|---|---|---|---|---|
| 5,784,032 | A | 7/1998 | Johnston et al. | |
| 5,905,473 | A | 5/1999 | Taenzer | |
| 6,034,638 | A | 3/2000 | Thiel et al. | |
| 6,288,682 | B1 | 9/2001 | Thiel et al. | |
| 6,369,770 | B1 | 4/2002 | Gothard et al. | |
| 6,417,806 | B1 | 7/2002 | Gothard et al. | |
| 6,515,634 | B2 * | 2/2003 | Desclos et al. | 343/818 |
| 6,606,057 | B2 | 8/2003 | Chiang et al. | |
| 6,888,504 | B2 * | 5/2005 | Chiang et al. | 343/702 |

OTHER PUBLICATIONS

Scott, et al., "Diversity Gain from a Single-Port Adaptive Antenna Using Switched Parasitic Elements Illustrated with a Wire and Monopole Prototype," IEEE Transactions on Antennas and Propagation, vol. 47, No. 6, Jun. 1999.

King, Ronold W.P., *The Theory of Linear Antennas*, pp. 635-637, Harvard University Press, Cambridge, Mass., 1956.

* cited by examiner

APERIODIC ARRAY ANTENNA

RELATED APPLICATION(S)

This application is a continuation of U.S. application Ser. No. 10/357,276, filed Jan. 31, 2003, now U.S. Pat. No. 6,888,504 which claims the benefit of U.S. Provisional Application Ser. No. 60/353,249, filed on Feb. 1, 2002, and U.S. Provisional Application Ser. No. 60/419,431, filed on Oct. 17, 2002. The entire teachings of the above application(s) are incorporated herein by reference.

BACKGROUND OF THE INVENTION

Various types of wireless communication systems may be used to provide radio communication between central base station (or access point) and one or more remote or mobile units. What they have in common is a base station, that is typically one or more computer controlled radio transceivers interconnected to a land-based network such as a Public Switched Telephone Network (PSTN) in the case of voice communication, or a Wireless Local Area Network (WLAN) for data communications. The base station includes an antenna apparatus for sending forward link radio frequency signals to the mobile units. The base station antenna is also responsible for receiving reverse link radio frequency signals transmitted from each mobile unit. Each mobile unit also contains an antenna apparatus for the reception of the forward link signals and for transmission of the reverse link signals. A typical mobile unit is a digital cellular telephone handset or a wireless modem or wireless adapter coupled to a personal computer.

The most common type of antenna used to transmit and receive signals at a mobile unit is a omni-directional monopole antenna. This type of antenna consists of a single wire or antenna element that is coupled to a transceiver within the subscriber unit. The transceiver receives reverse link signals to be transmitted from circuitry within the subscriber unit and modulates the signals onto the antenna element at a specified frequency assigned to that subscriber unit. Forward link signals received by the antenna element at a specified frequency are demodulated by the transceiver and supplied to processing circuitry within the subscriber unit. In many types of wireless cellular systems, multiple mobile subscriber units may transmit and receive signals on the same frequency and use coding algorithms to detect signaling information intended for individual subscriber units on a per unit basis.

The transmitted signal sent from a monopole antenna is omnidirectional in nature. That is, the signal is sent with the same signal strength in all directions in a generally horizontal plane. Reception of signals with a monopole antenna element is likewise omnidirectional. A monopole antenna does not differentiate in its ability to detect a signal on one direction versus detection of the same or a different signal coming from another direction.

SUMMARY OF THE INVENTION

One aspect of the present invention is directed towards beamforming in a portable cellular device. In an illustrative embodiment, an active antenna element capable of transmitting or receiving Radio Frequency (RF) signals is positioned between at least two passive antenna elements. The active antenna is preferably offset from an imaginary line drawn between the two passive antenna elements so that the active element does not lie in a common plane as the passive antenna elements. In a specific application, the passive and active antenna elements are positioned parallel with each other and the antenna elements form a triangular antenna array. More specifically, an angle formed by the antenna array, in which the active element is disposed at the vertex, can provide directional transmissions and 360 degrees of azimuth scanning. The antenna elements can be positioned to form an obtuse angle.

Another aspect of the present invention involves disposing the combination of active and passive antenna elements in a portable antenna device. For example, an antenna array including passive and active antenna elements can be disposed in a hinged, spring-loaded panel that is collapsible for easy storage. When opened, the antenna device can form a fixed or adjustable antenna array.

Generally, settings of the at least two passive antenna elements can be adjusted to vary an input/output beam pattern produced by the antenna array. More specifically, each of the at least two passive antenna elements of the antenna array can be individually set to a reflective or transmissive mode to change characteristics such as directivity and angular beamwidth of, for example, an input/output beam pattern of a corresponding wireless antenna device. Consequently, an input/output beam pattern of the cellular device can be more easily directed towards a specific target receiver such as a base station, reducing signal to noise interference levels and increasing a gain of the corresponding antenna device.

When a passive antenna element is set to a reflective mode, RF signals are generally reflected off the passive antenna to adjust a lobe pattern. Conversely, when in a transmissive mode, each passive antenna element allows RF signals to pass relatively unattenuated and supports directivity of an RF signal, enhancing a beam transmission in a particular direction. Based on settings of the at least two passive antenna elements, the input/output beam pattern can be adjusted based on a specific orientation of, for example, of the antenna array.

Characteristics of the at least two passive antennas can be adjusted based on weighted control signals. That is, the at least two passive antenna elements individually can be more or less reflective or transmissive depending on a weighted control signal driving the corresponding passive antenna element. Accordingly, an input/output beam of the antenna array can be selectively multiplexed or controlled to support beamsteering in almost any direction. The input/output beam pattern can be scanned to find an optimal setting for transmitting or receiving.

In one application, the at least one passive antenna element includes two passive antenna elements, each of which can be selectively set to a transmissive or reflective mode. An active antenna element can be positioned between the two passive antenna elements.

Spacing of the active antenna element and at least one passive antenna with respect to each other also can vary depending on the application. For example, the at least two passive antenna element can be spaced in relation to each other and the active antenna element depending on a frequency of operation. In one application, the passive antenna elements are disposed at about a quarter-wavelength from the active antenna element to enhance beamsteering capabilities. Spacing between the active and at least one passive antenna element can be around 3.5 and 4.5 inches for use in certain compact portable cellular devices, even though such a spacing is smaller than a quarter-wavelength of a corresponding carrier frequency upon which signals are transmitted and received.

The present invention has many advantages over the prior art. For example, a combination of active antenna elements and at least two passive antenna elements disposed to form an angle can be employed to adjust directionality, gain and angular beamwidth of an input/output beam pattern. In contradistinction to a linear array, the angular antenna array of the present invention does not include split or stray beam lobes as in the prior art. The few components comprising the antenna array can be easily assembled into a compact, portable cellular device. Consequently, a compact cellular device including the antenna device according to the principles of the present invention can cost less to manufacture, yet provide the benefits of reduced interference and fading not otherwise achieved with only a standard active element for transmitting and receiving RF signals.

Another benefit of supporting beamforming according to the principles of the present invention is the ability to more optimally communicate with a base station. The directionality of an output beam of a portable device can reduce power consumption. A collapsible antenna device including the antenna array can be more easily stowed away for easy shipping.

Another feature of the antenna array of the present is the ability to generate a high gain beam pattern that can be directed in any of 360 degrees. Each beam pattern can have approximately equal gain. Additionally, such an antenna array can support an omni-directional mode and is simple to manufacture for integration into a laptop computer.

The design concept starts from the basic smart antenna needs of the cellular wireless antenna system. They cover the ability to scan in azimuth (electrical property), low cost (marketing preference), and easy to use (consumer interface). Assuming the antenna elements are omni-directional, then the ability to scan the complete azimuth space requires a minimum of 3 elements. For low cost, two of the three elements are made passive. For ease of use, the array is arranged in an obtuse triangle, which makes it almost flat for easy stowing.

The slight offset of the source from the line joining the passive elements provides the means to form a unidirectional beam. Without the offset, the radiation pattern will have two identical main beams, one on each side of the array. The unidirectional beam can provide an extra 3 dB in broadside directivity, and improved interference rejection towards the rear of the beam. With this offset, unidirectional beams are formed to cover all azimuth angles.

The significance of this design is that it satisfies an extensive list of requirements of a cellular communication antenna.

1.) Wide Angular Coverage: The ability of this array to scan 360 degrees in azimuth is a high gain wide angular coverage. In addition, this array has an omni-directional mode.

2.) High Directivity: This array has a director and a reflector, so it forms a highly directive uni-direction beam. Given its size, its directivity of around 6 dBi is considered high.

3.) Interference rejection: This is satisfied by the fact that the pattern has a single steerable main beam and at least one null.

4.) Small Size: The minimum number of elements required by an array of omni-directional elements to scan 360 degrees is 3 elements, so 3 is chosen for this obtuse triangular array.

5.) Minimum Mutual Coupling Loss: This array minimizes mutual coupling loss by using just one active element, so that it has no lossy active ports to couple to. The 2 passive elements in the array are designed to scatter with very low loss. The loss of a passive element is primarily in the load it connects to. The loads used are the theoretically lossless components like switches, inductors, and capacitors. Even in practice, these components are very low in loss, so the problem of high mutual coupling loss in an electrically small array is eliminated.

6.) Minimum Circuit Loss: The signal generator source feeds a single active element with no power distribution circuit, so the source circuit loss is at its minimum. The passive elements are loaded with low loss components placed as close to the terminals as practical, so the passive element circuit loss is also minimal.

7.) Gain: With the losses minimized, the array is highly efficient, and its gain comes out ahead of the fully active array of similar size.

8.) High Power Handling Capability: In a fully active array, all components (power dividers, phase shifters, etc.) in the feed circuit must handle high transmitter power. In this array, the power divider is not used because there is just one active element. Furthermore, phase shifts are handled by the components in the passive antenna elements. The passive antenna elements process only a small fraction of the power of the active elements (typically 10 dB below the active element at 0.1 wavelength away), because the power reaching the passive elements is through spatial coupling. So the components can have their power ratings reduced by the same factor.

9.) Low Cost: The use of a mere 3 elements already puts the cost at a minimum. One active element means no power distribution components, so there is no cost for the hardware outside of the cost of the antenna itself. The passive elements require only lower cost low-power switches and reactive loads. The reactive loads can be short transmission line sections printed on the same circuit board that makes up the antenna, such that the cost of the load is included in the antenna. The remaining cost is in the switches and the controller. Switch and controller complexities are a function of the number of beam positions needed. Their cost is equivalent to other systems' cost. However, only two switches are required in this array as opposed to more than two in most other systems.

10.) Stowing Convenience: The array can be conveniently stowed in its obtuse triangular shape, which is almost flat. It can also be stowed completely flat. The novel stowing concept is described below, where the normal act of closing the laptop also stows the array. This feature makes the array user friendly.

Other various problems are also inherent in prior art antennas used on mobile subscriber units in wireless communications systems. Typically, an antenna array with scanning capabilities consists of a number of antenna elements located on top of a ground plane. For the subscriber unit to satisfy portability requirements, the ground plane must be physically small. For example, in cellular communication applications, the ground plane is typically smaller than the wavelength of the transmitted and received signals. Because of the interaction between the small ground plane and the antenna elements, which are typically monopole elements, the peak strength of the beam formed by the array is elevated above the horizon, for example, by about 30°, even though the beam itself is directed along the horizon. Correspondingly the strength of the beam along the horizon is about 3 db less than the peak strength. Generally, the subscriber units are located at large distances from the base stations such that the angle of incidence between the subscriber unit and the base station is approximately zero. The ground plane would have to be significantly larger than the wavelength of the transmitted/received signals to be able to bring the peak beam down towards the horizon. For example, in an 800 MHz cellular system, the ground plane would have to be significantly larger than 14 inches in diameter, and in a Personal Communication Services (PCS) system operating at about 1900 MHz (or WLANs operating at similar radio frequencies), the ground plane would have to be significantly larger than about 6.5 inches in diameter. Ground planes with such large sizes would prohibit using the subscriber unit as a portable device.

Another disadvantage of existing prior art antennas utilizing flat ground planes is that as the ground plane dimensions are reduced in size, the array input impedance becomes highly sensitive to the environment, for example, when the array is placed on a metal surface or table, because the external environment directly couples with the antenna. That is, the external environment becomes part of the antenna. If the dimensions of the ground plane are increased to a sufficient size, this coupling problem is minimized. However, the large size of these ground plans may be undesirable in many applications. Shaped ground planes have been used to pull the beam of monopole arrays down towards the horizon. These shaped ground planes have large three dimensional features. Thus, it is desirable to force the beam down towards the horizon with an antenna structure that is not too large and unwieldy.

The present invention greatly reduces problems encountered by the aforementioned prior art antenna systems. The present invention provides an inexpensive antenna array for use with a mobile subscriber unit in a wireless "same frequency" network communications system, such as CDMA cellular or WLAN communication networks. The invention utilizes at least two passive antennas and one active antenna disposed above a ground plane, but electrically isolated from the ground plane, and a respective resonant strip positioned beneath each passive antenna. The passive antenna elements and the resonant strips are positioned about the active antenna, and the resonant strips couple to respective passive elements to increase antenna gain by more efficiently utilizing the available ground plane area. Additionally, since the active element is on top of the ground plane, the antenna array sensitivity is decreased because the direct coupling between the antenna and external environmental factors is minimized.

In particular, the coupled resonant strip and passive element provides a unbalanced dipole antenna element so that the multiplicity of dipole antenna elements along with the active antenna element form a composite input/output beam which may be positionally directed along a horizon that is substantially parallel to the ground plane. Moreover, each of the at least two passive antenna elements are individually set to a reflective or a transmissive mode to change the characteristics of the input/output beam pattern of the antenna apparatus. The passive elements can be aperiodically spaced about the active antenna element.

In one embodiment, the passive elements and coupled resonant strips can be form on one side of a printed circuit board, and the active element on the other side. The circuit board thickness provides the offset from the in-line configuration, to provide the aperiodic structure.

Embodiments of the invention can also include one or more of the following features. The ground plane can be cylindrical such that the top side of the ground plane is a planar end of the cylinder, and the bottom side of the ground plane is an opposite planar end of the cylinder. In this arrangement, each resonant strip is disposed within a respective slot of the ground plane. The walls of each slot are spaced apart from the surface of the resonant strip, and the space between the walls and the surface is filled with nonmetallic material to electrically isolate a non-top end portion of the resonant strip from the ground plane.

In other implementations, the ground plane is made of a multiplicity of plates equal in number to the multiplicity of resonant strips. Each plate has an outer edge and an inner edge. The resonant strips are aligned along the outer edge of a respective plate, and the inner edges of the plates are joined together at the center of the ground plane forming a central joint with an axis that is substantially parallel to the axes of the resonant strips. The active element is aligned along the axis of the central joint. The central joint is a hinge which facilitates collapsing the antenna apparatus into a flat compact unit.

In certain embodiments, each plate includes a first nonmetallic substrate and a first conductive material layered over one side of the substrate. The conductive portion of the ground plane and the resonant strips are made of the same conductive material. Each plate can include a second nonmetallic substrate, a second conductive material sandwiched between the first substrate layer and the second substrate layer, and a third conductive material layered on an opposite side of the second nonmetallic substrate. The conductive portion of the ground plane and the resonant strips can be made of the first conductive material and the third conductive material.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
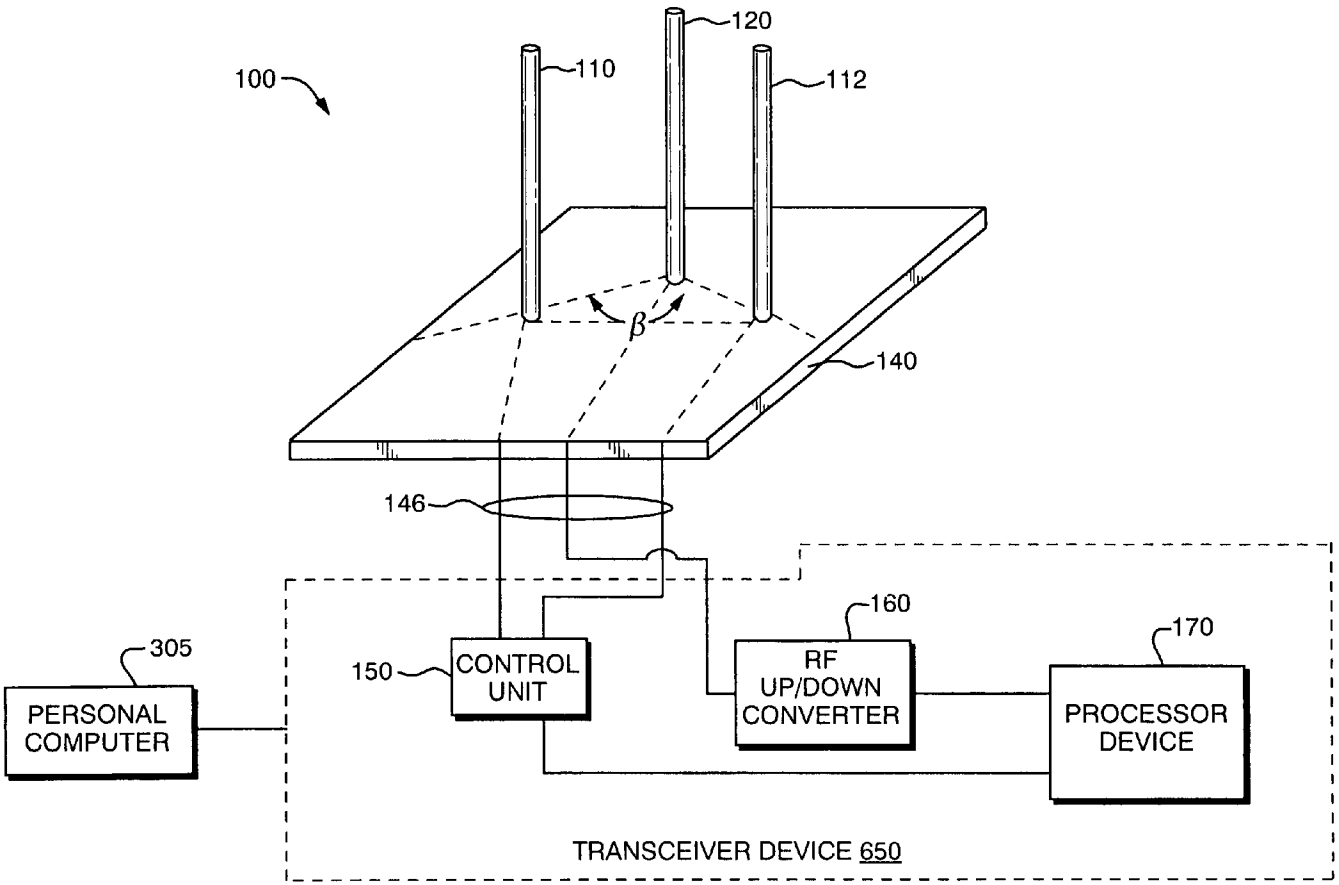
FIG. 1 is a block diagram and partial perspective view of an antenna device according to certain principles of the present invention.

FIG. 1 is a block diagram and partial perspective view of antenna device 100 according to certain principles of the present invention. As shown, active antenna element 120 is disposed between a first passive antenna element 110 and a second passive antenna element 112. Both active antenna element 120 and passive antenna elements 110 and 112 are generally parallel monpole elements, as shown. They are disposed so that they do not all lie in the same vertical plane with regard to each other, however. For example, an angle, β, having a vertex at active antenna element 120 is formed by a line drawn between the bases of the elements. Typically, the antenna elements are disposed so that angle β is an obtuse angle such as between 90 and 180 degrees, and close to 180 degrees. However, the exact amount of this angle can vary depending on the application.

Also, it should be noted that a number of passive antenna elements used in antenna device 100 is not necessarily only two, and the illustration of two passive antenna elements 110, 112 as shown in FIG. 1 is merely one possible embodiment. Different directional radiation patterns can be achieved by selecting a different number of elements.

Both active antenna element 120 and passive antenna elements 110 and 112 can be fixed to a support surface 140. However, antenna device 100 can be designed so that some or all of the antenna elements are retractable or adjustable. For example, some or all of the antenna elements can be automatically, manually, electronically or mechanically adjusted so that a corresponding device including antenna device 100 is compact (such as flat or planar) when not in use, yet still functional when opened and in use (as shown). Consequently, antenna elements can be portable and protected from damage during non-use.

The surface 140 can be a ground plane or other conductive surface or it may be a insulating surface such as a table upon top or a plastic case which antenna device 100 rests.

Although all of the antenna elements, namely, active antenna element 120 and passive antenna elements 110 and 112, are disposed to form angle β, actual positioning of multiple passive elements along the line can vary depending on the application. For example, each passive antenna element can be spaced a quarter-wavelength apart from its nearest neighbor. This spacing can enhance reception and transmission of RF signals at active antenna element 120. In one application, the spacing between elements is from about one inch up to ten inches.

Passive antenna elements 110 and 112 can be spaced more or less than a quarter wavelength from active antenna element 120. For example, each passive antenna element 110, 112 can be spaced 4 inches from active antenna element 120 in a application where the antenna is operating at cellular telephone radio frequencies. Even when a spacing of antenna elements is more or less than a quarter-wavelength of a carrier frequency at which antenna device 100 transmits and receives RF signals, antenna device 100 can still communicate effectively.

Active antenna element 120 can be a half dipole antenna, dipole or other omni-directional antenna device that generates an RF (Radio Frequency) signal axially outward in all directions. It should be noted that active antenna element 120 also can be a directional antenna device. During operation, however, a portion of the RF signal generated by active antenna element 120 can be reflected off passive antenna elements 110, 112 depending how they are set.

Generally, characteristics of passive antenna elements 110 and 112 can be adjusted by control unit 150 to form a Radio Frequency (RF) beam that is directed in any possible 360 degree as viewed from above. For example, control unit 150 can selectively apply weighting factors to adjust the impedance of each passive antenna element 110 and 112, controlling a degree to which they are reflective. Based on a selected weighting, corresponding characteristics of a passive antenna element can be adjusted so they are more reflective or less reflective. Additionally, corresponding characteristics of passive antenna elements 110 and 112 can be adjusted so that they are more transmissive or less transmissive.

The reflectivity or transmissiveness stats of a passive antenna depends on circuitry used to control passive antenna elements 110 and 112.

Processing device 170 interfaces with an RF up/down converter 160 to transmit and receive RF signals over active antenna element 120. Generally, techniques are employed to determine an optimal direction and angular beamwidth for transmitting and receiving signals such as encoded digital packets on antenna device 100 to a target device in a wireless communication system such as a cellular voice or data system or a local area data network. Based on desired settings, processing device 170 interfaces with control unit 150 which in turn selectively adjusts characteristics of passive antenna elements 110 and 112. Consequently, personal computer device 305 interfaced to transceiver device 650 can transmit and receive data information over antenna device.

As discussed, the input/output beam pattern of antenna device 100 varies depending how passive antenna elements 110 and 112 are set. For example, when either passive antenna element is set to the reflective mode, incident RF signals directed towards the corresponding passive antenna element are scattered or reflected in an opposite direction. Conversely, RF signals are transmitted through a passive element 110 or 112 when a corresponding passive antenna element is set to the transmissive mode. Characteristics of an in input/output beam pattern can therefore be dynamically adjusted for more optimally receiving or transmitting RF signals.

Figure 2:
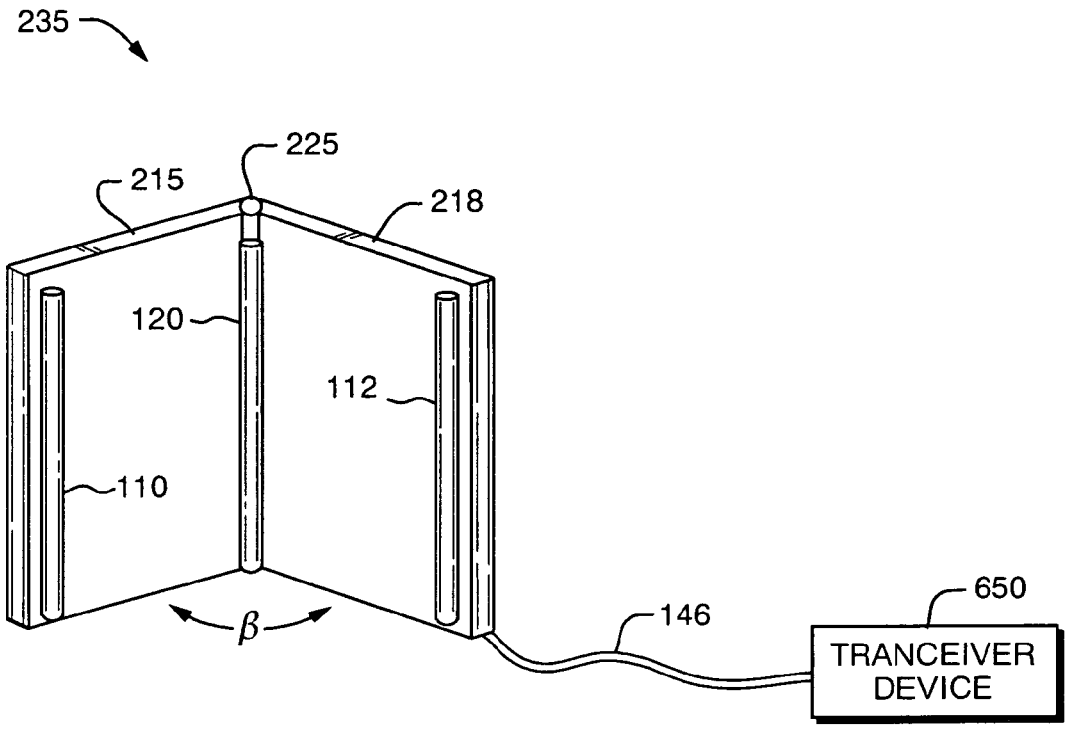
FIG. 2 is a perspective view of an antenna device coupled to a transceiver according to certain principles of the present invention.

FIG. 2 is a perspective view of an antenna device can be disposed in hinged panels according to certain principles of the present invention. As shown, a first panel 215 is connected via a hinge 225 to second panel 218. Hinge 225 can be spring loaded so that antenna device 225 opens to form an angle β when rested on a flat surface. Generally, antenna device can be opened and closed similar to a book.

Active antenna element 225 can be disposed along an axis of hinge 225 while passive antenna elements 110 and 112 are disposed respectively in outward lying portions of the first panel 215 and second panel 218. Antenna device 235 can be coupled to transceiver device 650 via wired cable 146.

In one implementation, hinge 225 includes a mechanical stop so that the first panel 215 and second panel 218 form angle β when opened. Alternatively, the panels can be adjusted by a user at one of multiple angles. Generally, panels 215 and 218 can be replaced with a flexible plastic form that can be rolled or folded for compact storage. In certain applications, it is only necessary that when a housing antenna device 100 opens up so that the active and passive antennas are parallel and form the angle β as shown.

Figure 3:
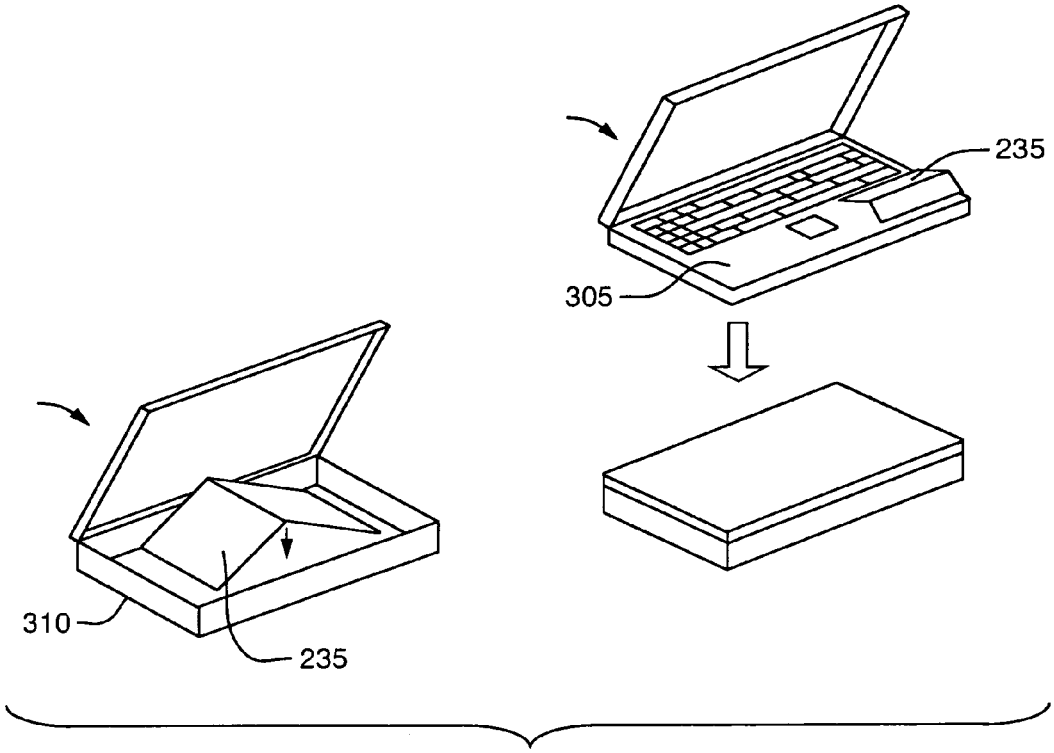
FIG. 3 is a perspective view of a collapsible or hinged antenna device according to certain principles of the present invention.

FIG. 3 is a perspective view illustrating one embodiment where the antenna device 235 antenna device 235 can be flattened to fit into briefcase 310. Also, antenna device 235 can be small enough to fit into interior surfaces of a portable computer 305.

One aspect of the present invention is directed towards alleviating the user from having to expend any effort to deploy or store antenna device 235 other than what is normally required to open and close a briefcase.

In one application, antenna device 235 supports RF communications at 2 Ghz. In such an application, dimension of panels 215 and 218 can be on the order of 2.9"×1.7"×0.2" while in an unstressed or open position. When antenna device 235 is this small, it can be stored inside of a laptop computer 305. For example, antenna device 235 can be sized to fit between a laptop screen and keyboard hand-rest of laptop computer 235.

Since the array formed by active antenna element 120 and passive antenna elements 110 and 112 generally form a straight line, the end-fire performance of this array deviates from the performance of a similar linear array. Antenna device 235 can be operated in an omni-directional mode.

Figure 4:
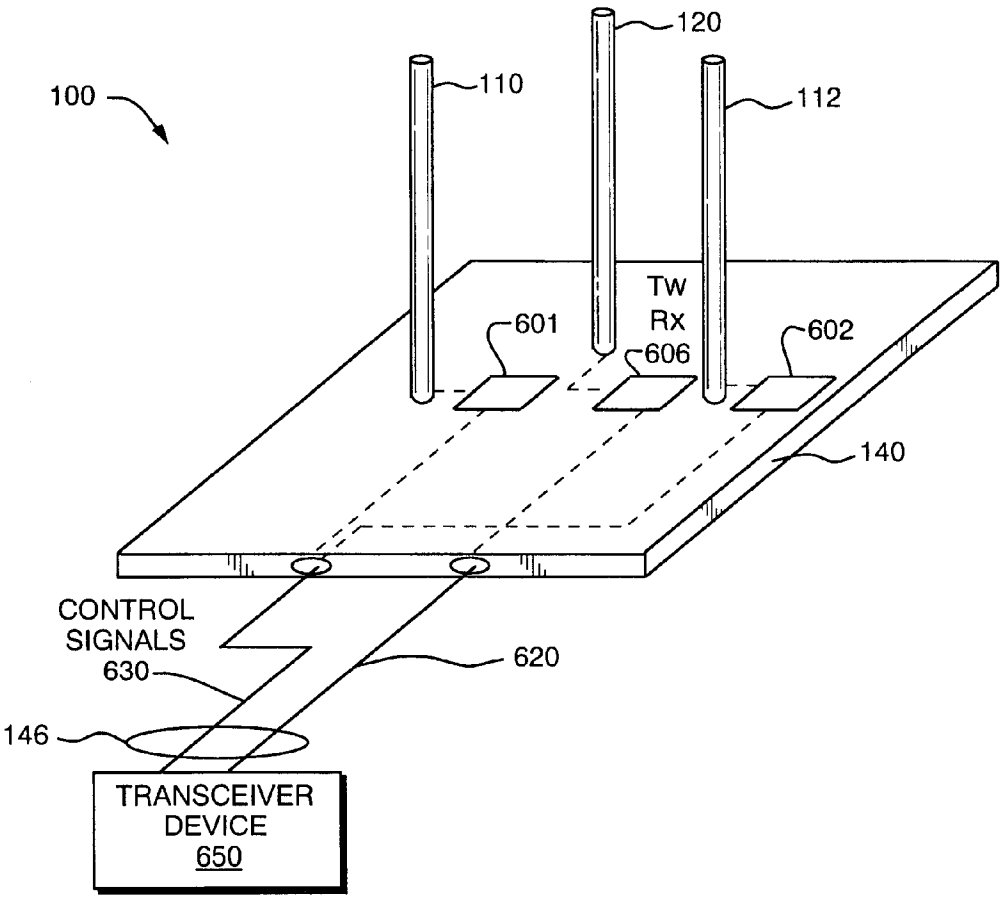
FIG. 4 is a block diagram and partial perspective view of a more detailed antenna device according to certain principles of the present invention.

FIG. 4 is a more detailed view of antenna device 100 and corresponding electronic circuitry according to certain principles of the present invention.

As mentioned, passive antenna elements 110 and 112 are selectably operated in one of two modes: reflective mode and transmissive mode. Processor 170 and control unit 150 can provide this control signal.

Each passive antenna element 110 and 112 can be adjusted to different impedances. In the reflective mode, passive antenna elements 110 and 112 are effectively elongated by being inductively coupled to ground. Conversely, in the transmissive mode, passive antenna elements 110 and 112 are effectively shortened by being capacitively coupled to ground. The direction of a beam steered by the antenna device 100, therefore, can be determined by knowing which passive antenna elements are in reflective mode and which are in transmissive mode. Generally, the direction of an input/output beam pattern extends to/from active antenna element 120, projecting past the passive antenna elements in transmissive mode and away from the passive antenna elements in reflective mode.

Figure 5:
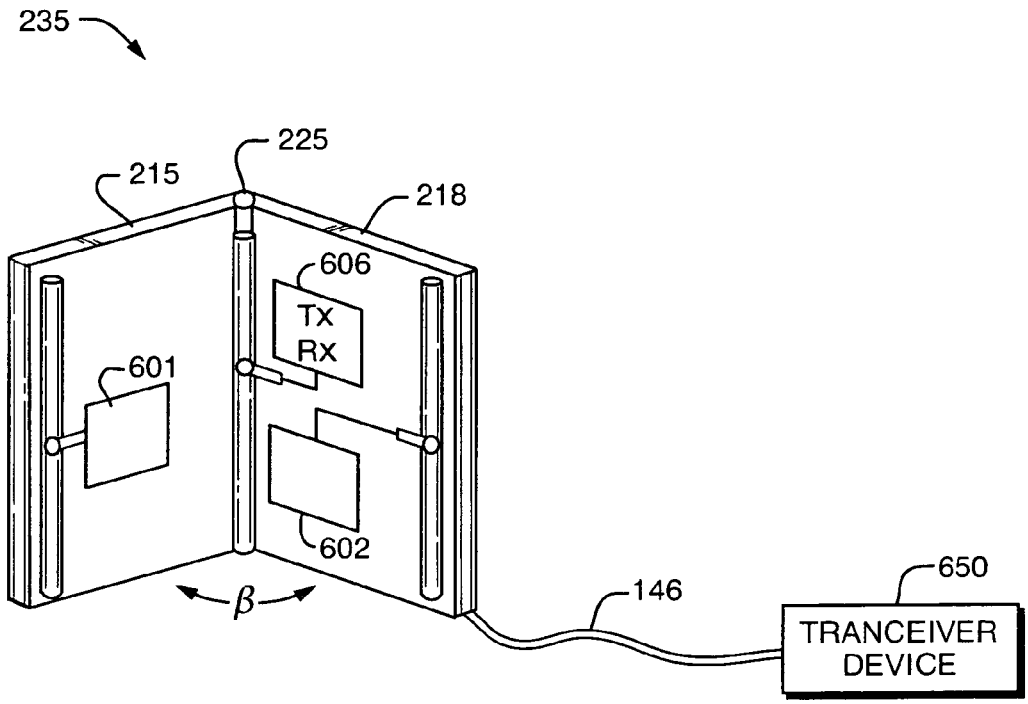
FIG. 5 is a perspective view of a hinged antenna device according to certain principles of the present invention.

In this embodiment, antenna device 100 includes a base plane 140 upon which the two passive antenna elements 110 and 112 and active antenna element 120 can be mounted. Base plane 140 can include adjustable impedance components. FIG. 5 illustrates the hinged case embodiment of the present invention in which antenna passive antenna elements 110, 112 and active antenna element 120 are mounted.

Continuing to reference FIG. 4, and according to the operation of antenna device 100, selectable impedance components 601 and 602 associated with a corresponding passive antenna element may be independently adjustable to affect the directionality of signals to be transmitted and/or received to or from transceiver device 650. By properly adjusting the phase for each passive antenna element during signal transmission by active antenna element 120, a composite beam is formed that may be positionally directed towards a target. That is, the optimal phase setting is such that device 100 is a phase setting for each passive antenna element 110 and 112 that re-radiates RF energy to assist in creating a directional reverse link signal. The result is an antenna device 100, 235 that directs a stronger reverse link signal pattern in the direction of the intended receiver base station.

Phase settings used for re-radiating RF energy of transmission signals also cause passive antenna elements 110 and 112 to allow active antenna element 120 to optimally receive forward link signals that are transmitted from a base station. Due to the programmable nature and the independent phase setting of each passive antenna element, only forward link signals arriving from a direction that are more or less in the location of the base station are received on active antenna 120. Passive antenna elements 110, 112 naturally reject other signals that are not transmitted from a similar location as are the forward link signals. In other words, a directional antenna beam is formed by independently adjusting the phase of each passive antenna element. This form of isolation can reduce interference among multiple users sharing limited wireless bandwidth. Multipath fading also thus can be reduced.

Adjustable impedance components shift the phase of the reverse link signal in a manner consistent with re-radiating RF energy by an impedance setting associated with that particular selectable impedance component, respectively, as set by an impedance control input 630. In one embodiment, the impedance control input 730 is provided over a number of lines equal to the number of passive antenna elements, two, multiplied by the number of impedance states minus one for each of the selectable impedance components 601 and 602. For example, if the selectable impedance components 601 and 602 have two states, then there are two lines. Alternatively, a serial encoding method of the states may be employed to reduce the number of control lines. Decode circuitry disposed on base plane 140 or panels 215, 218 can be used to decode control commands.

By shifting the phase of the re-radiated RF energy of a transmitted signal from each passive element 110 and 112, certain portions of the transmitted signal will be more in phase with other portions of the transmitted signal. In this manner, portions of signals that are more in phase with each other will combine to form a stronger composite beam. The amount of phase shift provided to each antenna element 110 and 112 through the use of selectable impedance components 601 and 602, respectively, determines the direction in which the stronger composite beam will be transmitted, as described above in terms of reflectance and transmittance.

The phase settings provided by the selectable impedance components 601 and 602, used for re-radiating RF signals from each passive antenna element 110 and 112, as noted above, provide a similar physical effect on a forward link frequency signal that is received from a base station or other transmitting device. That is, as each passive antenna element 110 and 112 re-radiates RF energy. Respective received signals will initially be out of phase with each other due to the location of each passive antenna element 110 and 112 upon the base plane 140. However, each received signal is phase-adjusted by the selectable impedance components 601 and 602. The adjustment brings each signal in phase with the other re-radiated signals. Accordingly, when each signal is received by the active antenna element 120, a composite received signal at active antenna element 120 will be more accurate and strong in the direction of the base station.

To optimally set the impedance for each selectable impedance component 601 and 602 in antenna device 100, the selectable impedance components 601 and 602 control values are provided by control unit 150 (FIG. 1). Generally, in the preferred embodiment, control unit 150 determines these optimum impedance settings during idle periods when transceiver device 650 is neither transmitting nor receiving data via antenna device 100. During this time, a predetermined received signal such as a forward link pilot signal, is continuously sent from a base station and is received on each passive antenna element 110 and 112 and active antenna element 120. That is, during idle periods, the selectable impedance components are adjusted to optimize reception of the pilot signal from a base station, such as by maximizing the received signal energy or other link quality metric. This provides the optimum impedance setting for a particular angle of arrival.

Processor 170 thus determines an optimal phase setting for each passive antenna element 110 and 112 based on an optimized reception of a current pilot signal. Processor 170 then provides and sets the optimal impedance for each selectable impedance component 601 and 602. When the antenna device 100 enters an active mode for transmission or reception of signals between the base station and transceiver device 650, the impedance settings of the adjustable impedance components 601 and 602 remain as set during the previous idle time period.

Before a detailed description of phase (i.e., impedance) setting computation as performed by processor 170 is given, it should again be understood that the principles of the present invention are based in part on the observation that the location of the base station in relation to any one portable or mobile subscriber unit (i.e., transceiver device 650) is approximately circumferential in nature. That is, if a circle were drawn around a mobile subscriber unit and different locations are assumed to have a minimum of one degree of granularity between any two locations, a base station can be located at any of a number of different possible angular locations. Assuming accuracy to one degree, for example, there are 360 different possible phase setting combinations that exist for antenna device 100. Each phase setting combination can be thought of as a set of two impedance values, one for each selectable impedance component 601 and 602 electrically connected to respective passive antenna elements 110 and 112. It should be noted that transceiver device 650 can include any suitable number of active antenna elements or passive antenna elements.

There are, in general, at least two different approaches to finding the optimized impedance values. In the first approach, control unit 150 performs a type of optimized search in which all possible impedance setting combinations are tried. For each impedance setting (in this case, for each one of multiple angular settings), two precalculated impedance values are read, such as from memory storage locations in the control unit 150, and then applied to the respective selectable impedance components 601 and 602. The response at a receiver is then detected by the control unit 150. After testing all possible angles, the one having the best receiver response, such as measured by maximum signal to noise ratio (e.g., the ratio of energy per bit, $E_b$, or energy per chip, $E_c$, to total interference, $I_o$), can be used to transmit or receive an RF signal.

In a second approach, each impedance value is individually determined by allowing it to vary while the other impedance values are held constant. This perturbational approach iteratively arrives at an optimum value for each of the two impedance settings.

Figure 6:
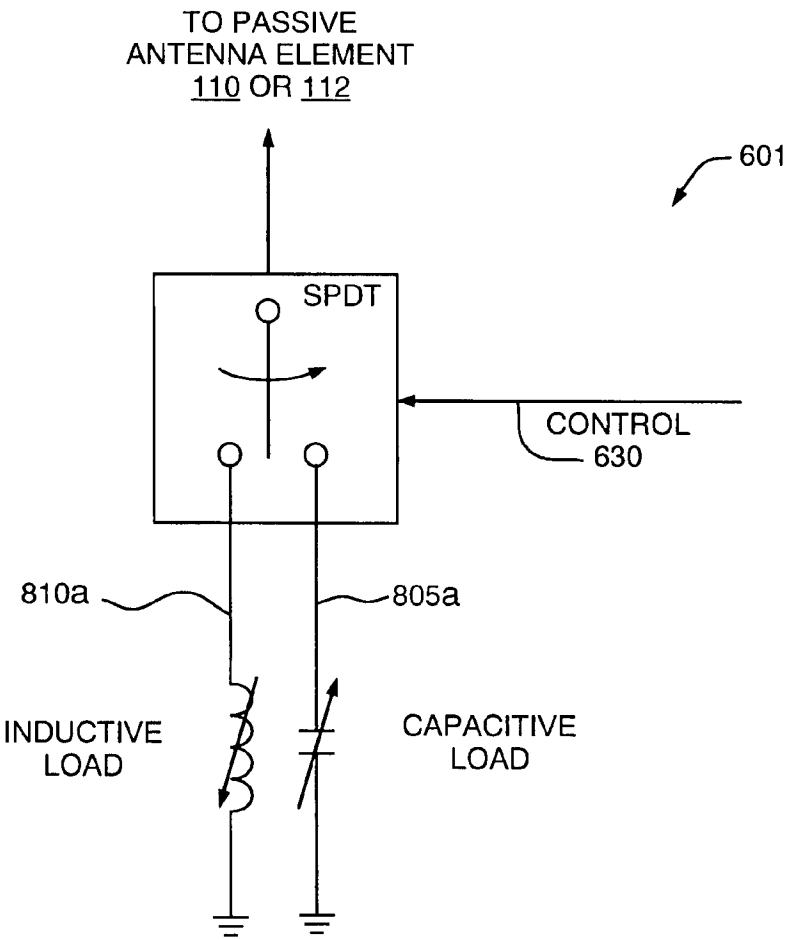
FIG. 6 is a block diagram of a selectively controlled impedance component for adjusting the characteristics of a passive antenna element according to certain principles of the present invention.

FIG. 6 is an embodiment of a selective impedance component 601 coupled to its respective passive antenna element 110. The selectable impedance component 601 includes a switch 801*a*, capacitive load 805*a*, and inductive load 810*a*. Both the capacitive load 805*a* and inductive load 810*a* are connected to a ground plane, as shown.

Switch 801*a* is a single-pole, double-throw switch controlled by a signal on control line 630. When the signal on the control line 630 is in a first state (e.g., digital 'one'), switch 801*a* electrically couples passive antenna element 110 to the capacitive load 805*a*. The capacitive load makes the passive antenna element 110 effectively shorter. When the signal on the control line 630 is in a second state (e.g., digital 'zero'), switch 801*a* electrically couples passive antenna element 110 to inductive load 810*a*, which makes passive antenna element 110 effectively taller, and, therefore, reflective.

Figure 7:
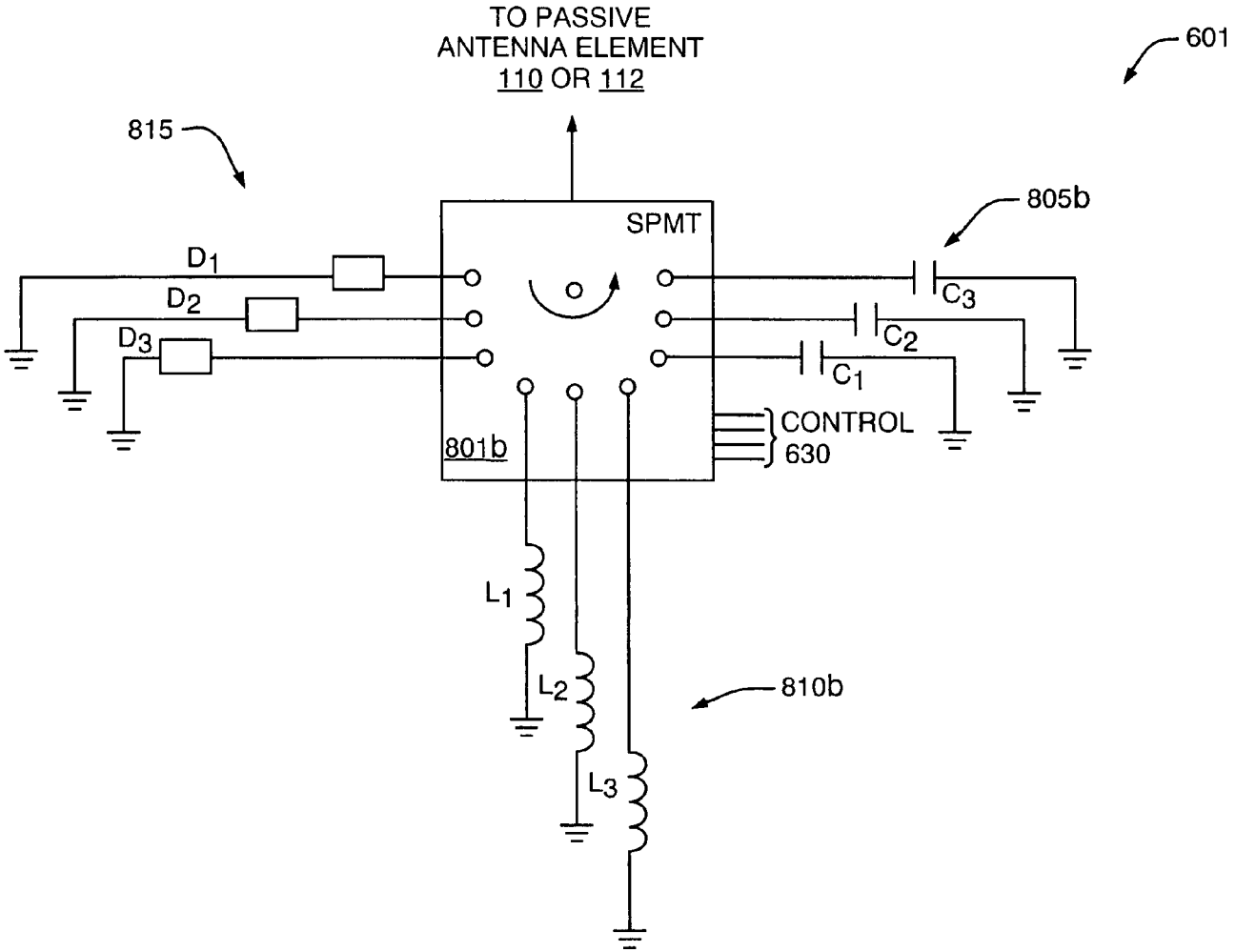
FIG. 7 is a block diagram of a selectively controlled impedance component for adjusting the characteristics of a passive antenna element according to certain principles of the present invention.

FIG. 7 is an alternative embodiment of the selectable impedance component 601 coupled to its respective passive antenna element 110. In this embodiment, selectable impedance component 601 includes a SPMT (Single Pole, Multiple Throw) switch 801*b* connected to several different, discrete, impedance components each having multiple predetermined values.

Switch 801*b* is a single-pole, multi-throw switch controlled by Binary-Coded Decimal (BCD) signals on four control lines 630. The signal on the four control lines 630 command a pole 803 of the switch 801*b* to electrically connect the passive antenna element 110 to 1-of-16 different impedance components. As shown, there are only nine impedance components provided for coupling to passive antenna element 110.

Selectable impedance components can include capacitive elements 805*b*, inductive elements 810*b*, and delay line elements 815. Each of the impedance components is electrically disposed between the switch 801*b* and a ground plane.

In this embodiment, capacitive elements 805*b* include three capacitors: $C_1$, $C_2$, and $C_3$. Each capacitor has a different capacitance to cause passive antenna element 110 to have a different transmissibility when connected to the passive antenna element 110. For example, the capacitive elements 805*b* may be of an order of magnitude a part in capacitance value from one another.

Similarly, inductive elements 810*b* can include three inductors: $L_1$, $L_2$, and $L_3$. The inductive elements 810*b* may have inductance values an order of magnitude apart from one another to provide different reflectivities for passive antenna element 110 when connected to the passive element 110.

Similarly, delay line elements 815 include three different lines: $D_1$, $D_2$, and $D_3$. Delay line elements 815 may be sized to create a phase shift of the signal re-radiated by the passive antenna element 110 in, say, thirty degree increments.

In an alternative embodiment, switch 801*b* may be a double-pole, double-throw switch to provide different combinations of impedances coupled to the passive antenna element 110 to provide various combinations of impedances. In this way, the passive antenna element 110 can be used to re-radiate RF energy to active antenna element 120 with various phase angles to allow the antenna device 100 to provide a directive beam at various angles. In one case, the control unit 150 (i) selects a first impedance combination to provide a receive beam at one angle by antenna device 100 and (ii) provides a second impedance component combination to generate a transmit beam at a second angle by antenna device 100. It should be understood that choosing combinations of selectable impedance components 805*b*, 810*b*, and 815 are made in a similar manner at the other selectable impedance components 602 coupled to the other passive antenna elements 112, respectively.

Alternative technology embodiments of switch 801*b* are possible. For example, switch 801*b* may be composed of multiple single-pole, single-throw switches in various combinations. Switch 801*b* may also be composed of solid-state switches, such as GaAs switches or pin diodes and controlled in a typical manner. Such a switch may conceivably include selectable impedance component characteristics to eliminate separate impedance or delay line components. Another embodiment includes Micro-Electro Machined Switches (MEMS), which act as a mechanical switch, but have very fast response times and an extremely small profile.

Figure 8:
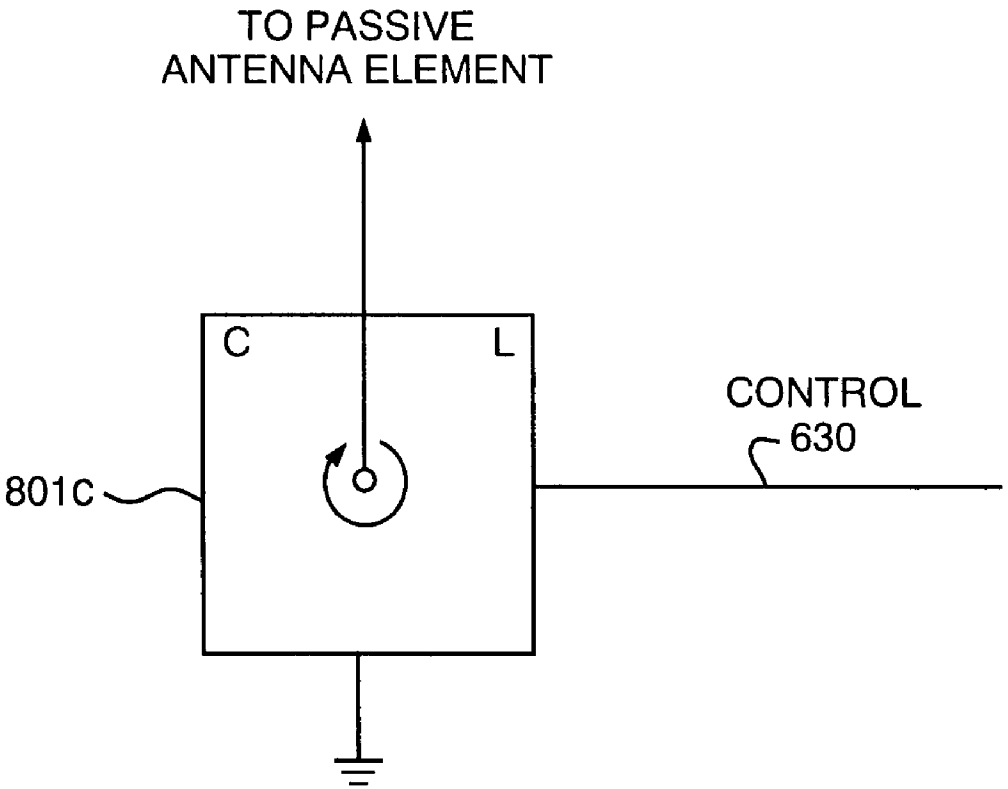
FIG. 8 is a block diagram of a selectively controlled impedance component for adjusting the characteristics of a passive antenna element according to certain principles of the present invention.

FIG. 8 is yet another alternative embodiment of the selectable impedance component 601 connected to the passive antenna element 110. In this embodiment, the selectable impedance component 601 is composed of a varactor 801*c*. The varactor 801*c* is controlled by an analog signal on a control line 630. In an alternative embodiment, the varactor 801*c* is controlled by BCD signals on digital control lines. The varactor 801*c* is connected to a ground plane as shown. Varactor 801*c* allows analog-type phase shift selectability to be applied to passive antenna element 601. It should be understood that each passive antenna elements 110 and 112, in this embodiment, are connected to respective varactors to provide virtually infinite phase shifting via the virtually infinite selectable impedance values of the varactors. In this way, the antenna device 100 can provide directive beams in virtually any direction; for example, in one degree increments in 180 degrees of a circle.

Figure 9A:
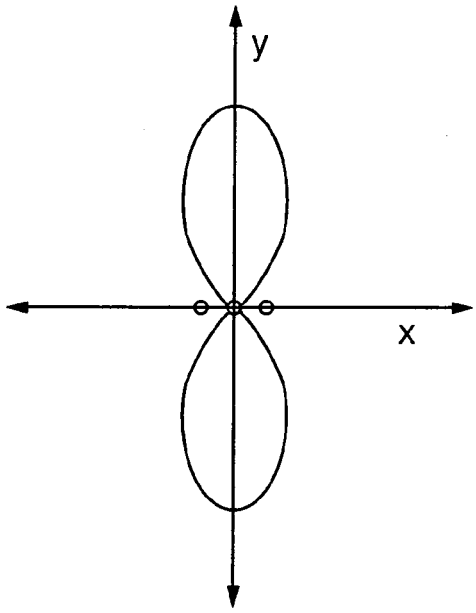
FIGS. 9A and 9B are top views of a lobe pattern produced by a linear antenna array.
Figure 9B:
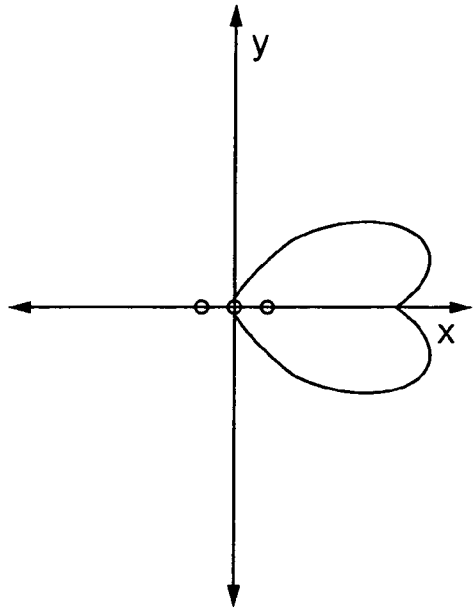

FIGS. 9A and 9B are top views of a linear antenna array. Generally, a radiation pattern is a symmetrical along an axis of the array. Thus, at least a portion of the radiated beam is wasted since it is not directed towards a target. Gain is therefore reduced and half the beam energy as shown in FIG. 9A is directed in an opposite direction of a target. While in a receive mode, the back lobe can pick up unwanted interference signals. FIG. 9B illustrates that a linear array produces a two-pronged lobe.

Figure 10A:
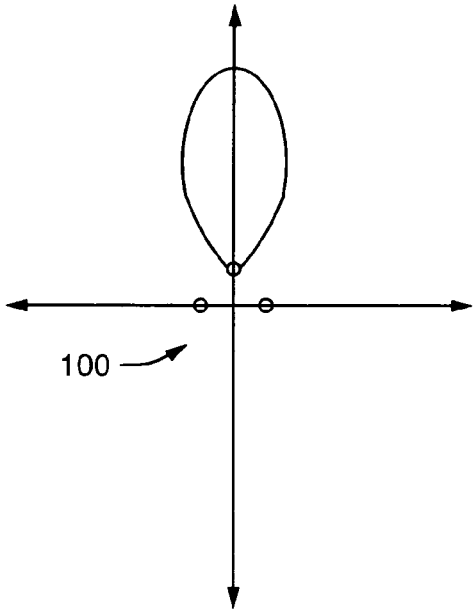
FIGS. 10A and 10B are top views of a directional beam produced by an antenna device according to certain principles of the present invention.
Figure 10B:
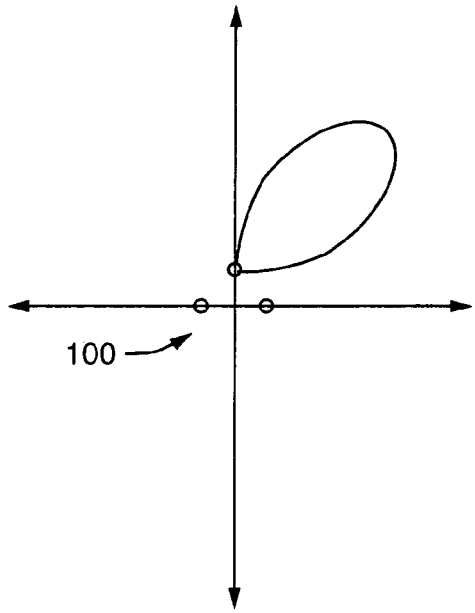

FIGS. 10A and 10B both illustrate directional beams for transmitting and receiving wireless signals on an asymmetrical (i.e., aperiodic) array according to certain principles of the present invention. A single beam with high gain can be formed by antenna device 100 when the impedance of passive antenna elements 110 and 112 are set to a reflective mode. A small displacement of active antenna element 120 from a plane including passive antenna elements 110 and 112 supports a spatial phase to cancel a back lobe otherwise picking up interfering signals. Properly adjusting passive antenna elements 110, 112 results in a narrower beam with higher gain and directivity. This configuration can improve gain by a factor of 3 dB (decibels).

In one application, antenna array 100 is tuned to optimally transmit around 800 MHz (Megahertz) and has the dimensions of 6.9"×4"×0.5". That is, the passive antenna element 110, 112 can be spaced at approximately 4" apart, each antenna element having an approximate height of 7". Active antenna element 120 can be spaced 0.5" away from an imaginary line drawn between each passive antenna element 110, 112.

FIGS. 11–14 illustrate directive beams that can be achieved by adjusting the effective impedance of each passive antenna element 110, 112. The azimuth plane illustrates a top view of a lobe pattern looking down on antenna array as oriented in the figure. The elevation plane illustrates a side view of a lobe pattern produced by antenna device 100, 235. As shown, an achievable range of directivity is between 5 and 7 dBi and front to back ratio is between 6 and 29 db. Note that each of the figures identifies an impedance setting of each passive antenna 110, 112 that is used to produce a corresponding directive beam.

Figure 11:
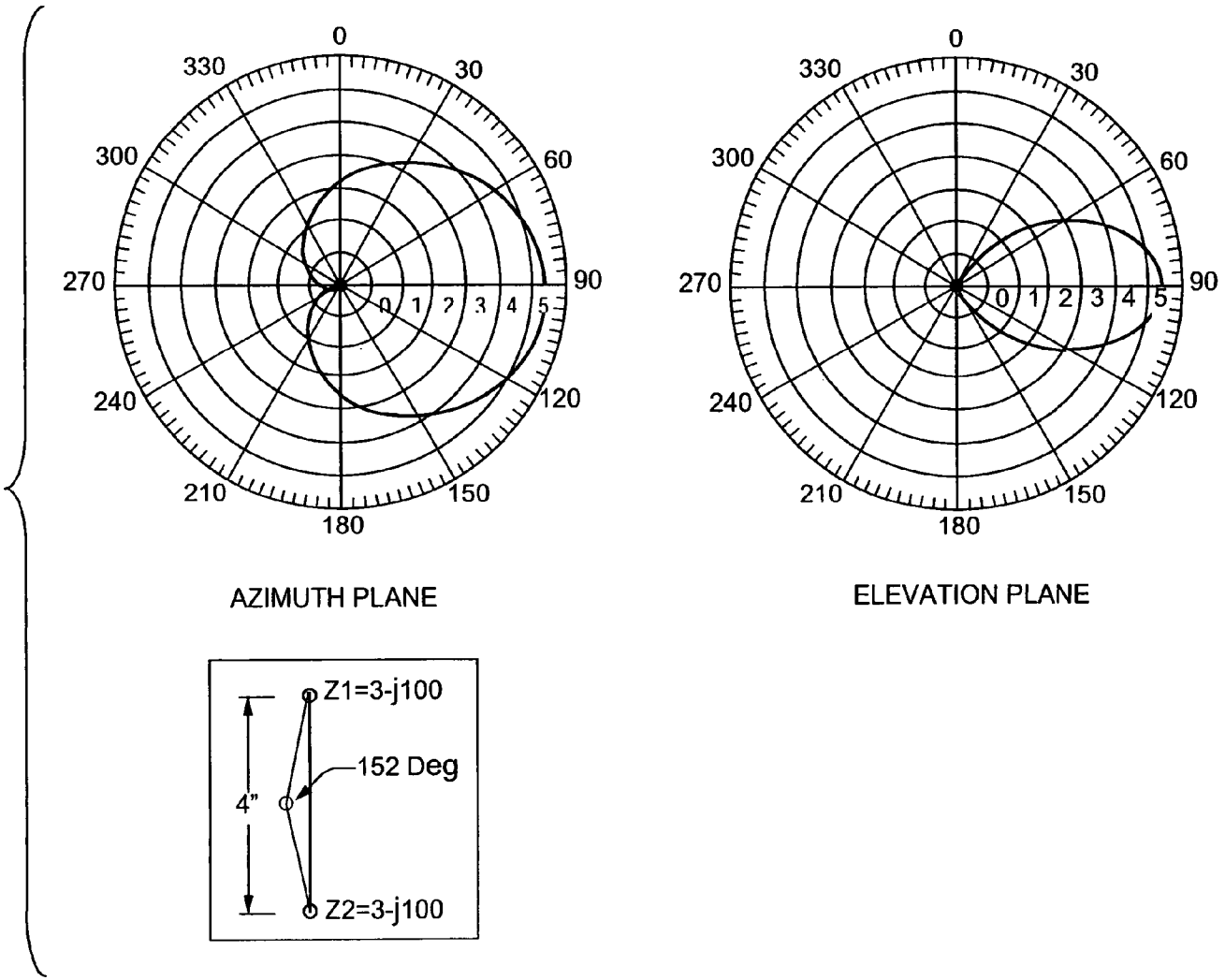
FIG. 11 is a top view and side view of a directional beam produced by an antenna device according to certain principles of the present invention.

FIG. 11. The Broadside-Right Radiation Pattern. The Array shown was simulated at 800 MHz. The Array was 4" wide, 0.5" deep, forming an angle of 152 degrees. The elements are 6.9" tall. The Load impedances are shown as Z1 and Z2. The 3-ohm is the equivalent Loss Resistance. With 100 ohm capacitive, the Beam was formed at Broadside-Right. The Directivity was 5.33 dBi, and the Gain was 5.08 dBi. The Azimuth Pattern is shown to the Left and the Elevation Pattern to the Right. The Front to Back Ratio is 6 dB.

Figure 12:
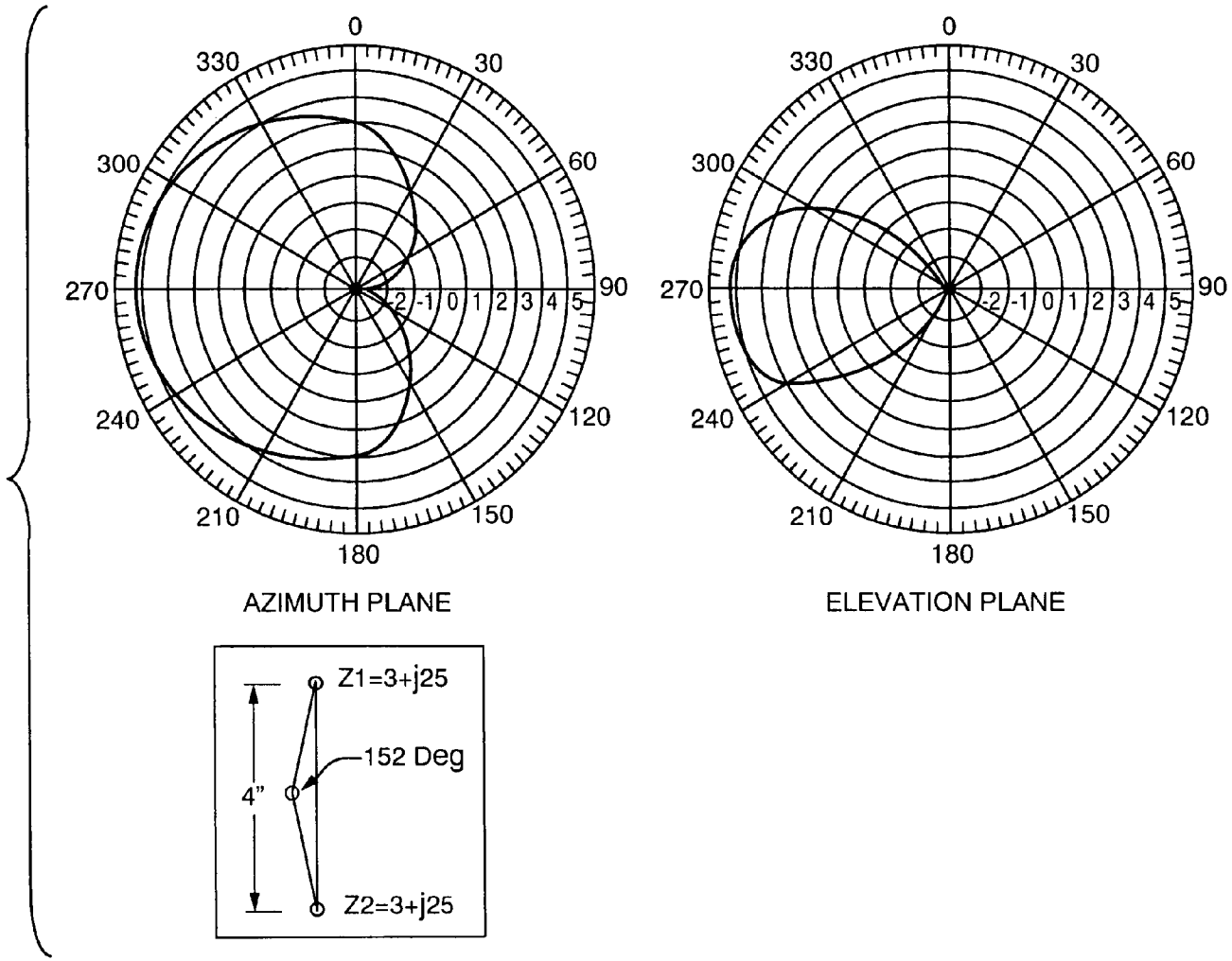
FIG. 12 is a top view and side view of a directional beam produced by an antenna device according to certain principles of the present invention.

FIG. 12. Radiating Broadside-Left. The Reactance of Z1 and Z2 were changed to 25 ohms Inductive. The Pattern points were to the Left. The 800 MHz Directivity was 5.25 dBi, and the Gain was 4.64.

Figure 13:
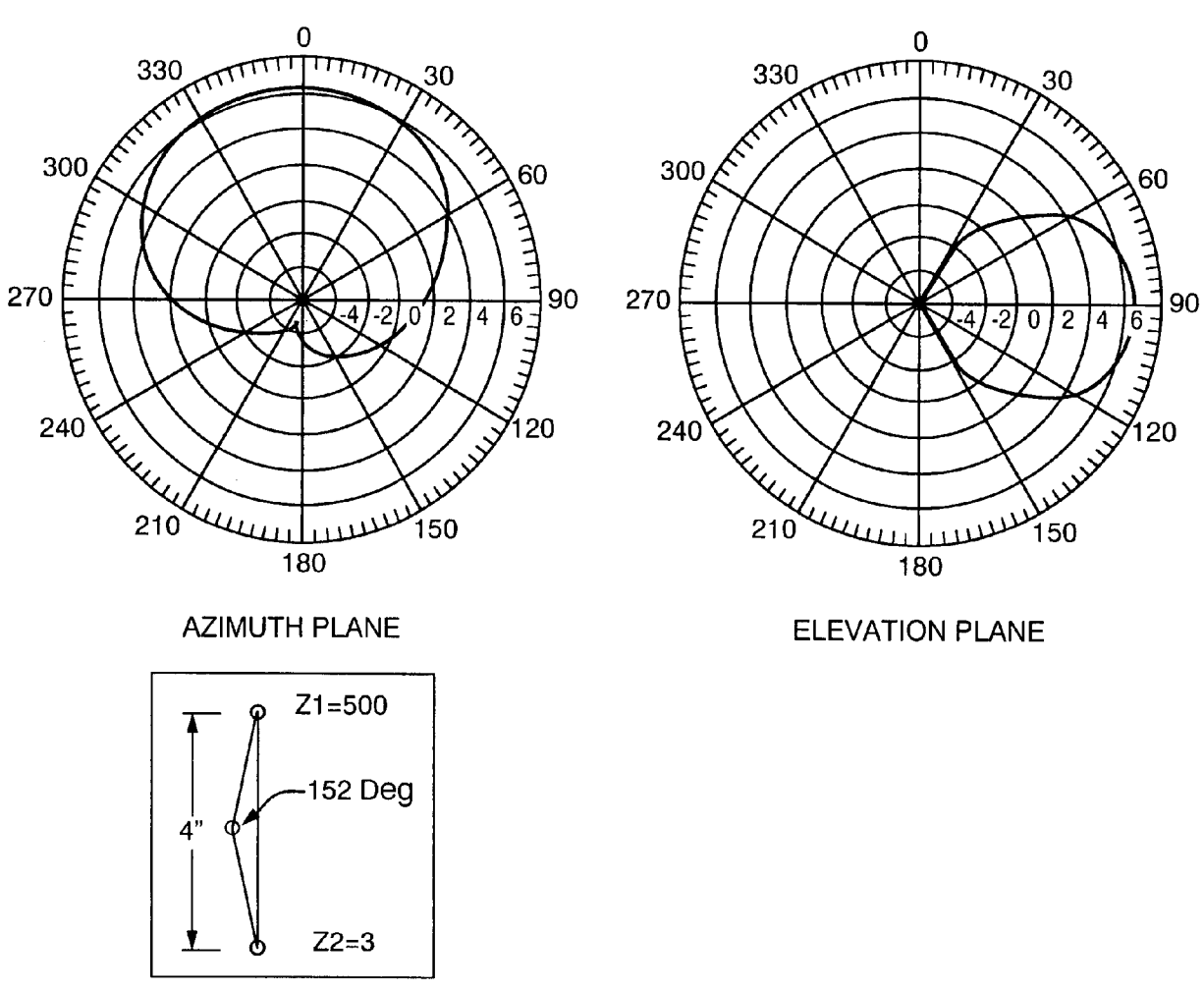
FIG. 13 is a top view and side view of a directional beam produced by an antenna device according to certain principles of the present invention.

FIG. 13. End Fire Pattern. This pattern was achieved with one of the two Passive Elements Open-circuited (represented by 500 ohm switch resistance) and the other Short-Circuited. The 800 MHz Directivity was 6.49 dBi, and the Gain was 5.42 dBi. The Gain could be improved with better input Impedance match. The Front to Back Ratio was 10 dB.

Figure 14:
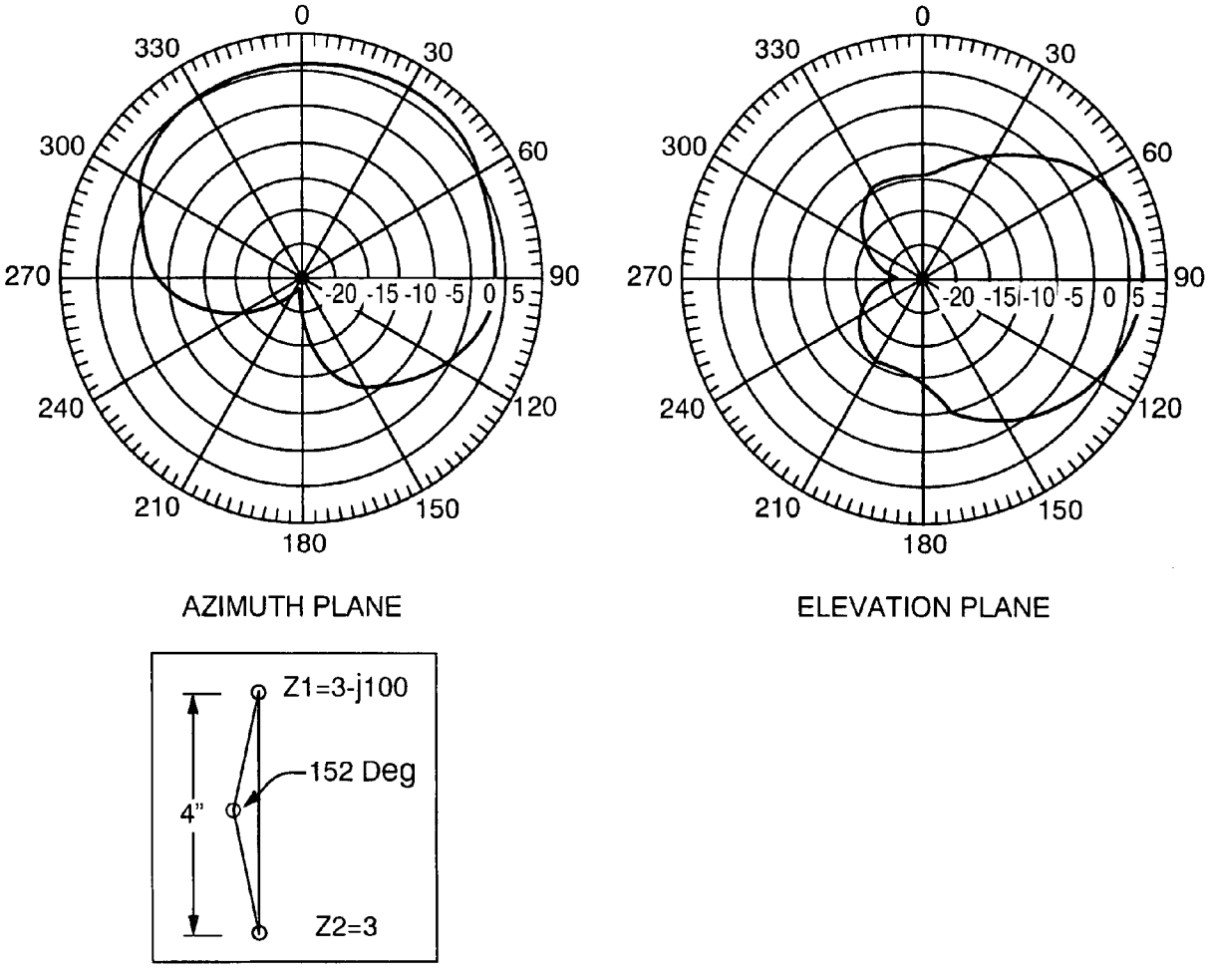
FIG. 14 is a top view and side view of a directional beam produced by an antenna device according to certain principles of the present invention.

FIG. 14. Off End-Fire Pattern. When the Impedances are manipulated further, the Radiation Pattern can be made to point at any Azimuth direction. One example is when Z1 is capacitive, and Z2 is Shorted. The Pattern points off End-Fire to the Right by about 25 degrees. The Directivity is 7 dBi and the Gain is 6.73 dBi. The Front to Back Ratio is 29 dB.

As mentioned in the above discussion, the number of passive antenna elements can depend on the particular application, and that the use of two passive antenna elements 110, 112 as shown in FIG. 1 has merely for illustrative purposes.

Figure 17A:
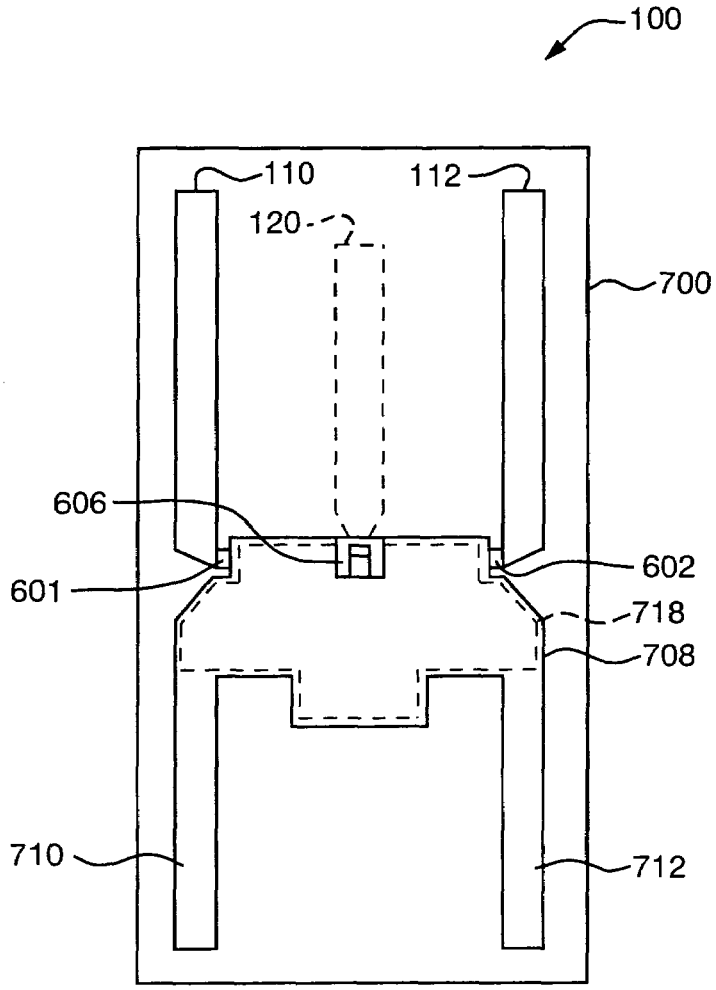
FIGS. 17A and 17B illustrate another embodiment of the aperiodic array as implemented on a printed circuit board.
Figure 17B:
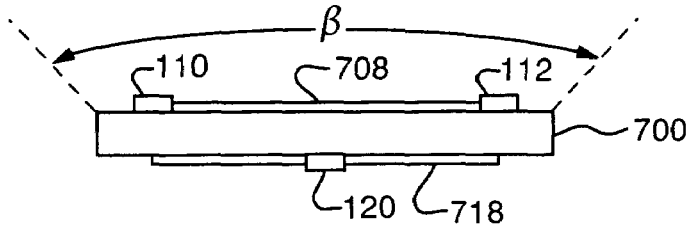

FIGS. 17A and 17B illustrate yet another embodiment of aperiodic antenna apparatus 100. Here the two passive antenna elements 110, 112 are formed on one side of a printed circuit board 700 and the active element 120 is formed on the other side. The thickness of the printed circuit board provides the required offset from a perfectly planar arrangement. In this embodiment, the impedance components 601 and 602 and even portions of the transceiver 606 may be conveniently disposed on the printed circuit board 700. (Details of the control lines and such have been eliminated in this embodiment for clarity.)

In this particular embodiment, there is also shown a ground structure 708 and respective resonant shapes 710 and 712. The ground structure 708 performs the function of the ground planes described in the earlier embodiments above.

The resonant shapes 710 and 712 provide additional radiant images of the passive elements 110 and 112 respectively. Thus, each passive element essentially becomes an monopole with its image appearing as a dipole element. In fact, the passive radiating elements 110, 112 are not dipoles but monopoles having respective resident images thereof. The significance of this difference lies in the fact that this particular embodiment does not need a balun for feeding or loading.

As shown in FIG. 17B the thickness of the printed circuit board provides a differential in the planar locations of the passive elements 110 and 112 with respect the active element 120 thereby forming the angle, β, as shown.

In a preferred embodiment, a ground structure 718 also is located on the same side of the circuit board 700 as the active element 120. The ground structures 708 and 718 assist with eliminating the effect of nearby impedance during objects such as a human hand. It should also be understood from this illustration that the resonant structures 710 and 712 are preferably connected to or part of the ground structure 708. Resonant shape 710 and 712 are roughly a quarter wave length with the free end able to resonate. In other embodiments these can be one-half wavelength with shorted ends which also provides the required resonance.

In addition, while the resonant structures 710 and 712 are shown as straight rectangular shaped sections, they could be implemented as meander lines or other odd shapes as desired. What is important is that they provide a resonance structure connected to part of the ground plane to balance out the monopole presented by the corresponding one of the passive elements 110 or 112.

In another embodiment, the antenna elements could be implemented as dipole elements as desired on opposites sides of the printed circuit board 700.

The spacing of the passive elements with respect to the active element may be implemented in various ways as long as it provides the required aperiodic spacing. For example, considering an arch of a circle, the passive elements may be located on an arch with the center element offset from the center of the arch.

Figure 15B:
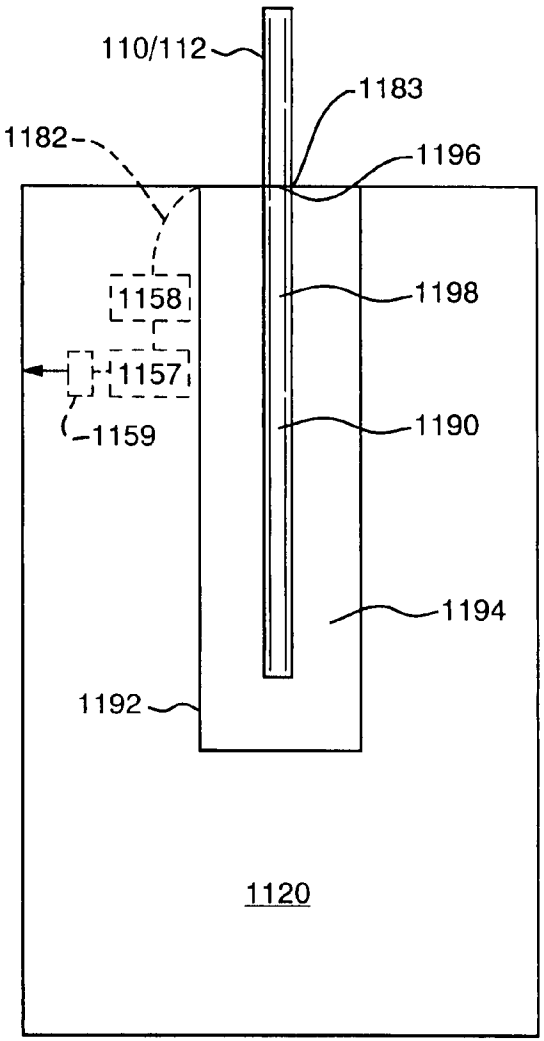
FIG. 15B is a close-up cutaway view of a passive antenna element of the antenna array of FIG. 15A.
Figure 15A:
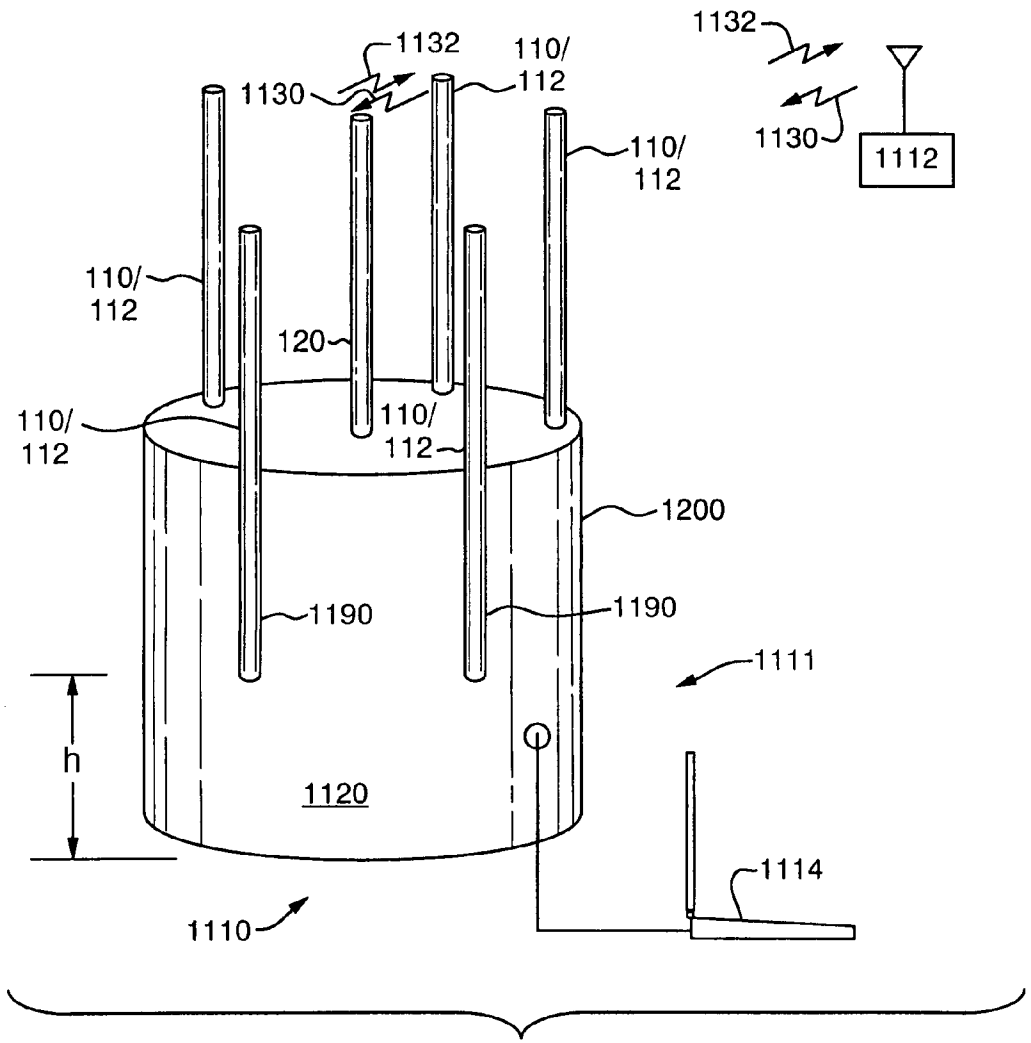
FIG. 15A is perspective view of an antenna array used by a mobile subscriber unit in a cellular system according to certain principles of the present invention.

By way of another example, there is shown in FIG. 15A an antenna apparatus 1110 with a single active antenna 120 surrounded by five passive antenna elements 110/112. Each of the passive antenna elements 110/112 operate as the passive antenna element 110 or the passive antenna element 112 according to the principles and techniques described earlier. That is, if one of the passive antenna elements 110/112 is identified as a passive antenna element 110, then the passive antenna elements on either side of it would function as a passive antenna element 112.

Antenna apparatus 1110 serves as the means by which transmission and reception of radio signals is accomplished by a subscriber unit 1111, such as a laptop computer 1114 coupled to a wireless cellular modem, with a base station 1112. The subscriber unit provides wireless data and/or voice services and can connect devices such as the laptop computer 1114, or Personal Digital Assistants (PDAs) or the like through the base station 1112 to a network which can be a Public Switched Telephone Network (PSTN), a packet switched computer network, or other data network such as the Internet or a private intranet. The base station 1112 may communicate with the network over any number of different efficient communication protocols such as primary ISDN, or even TCP/IP if the network is an Ethernet network such as the Internet. The subscriber unit may be mobile in nature and may travel from one location to another while communicating with base station 1112. In the typical scenario, a number of subscriber access units 1111 are located within the area surrounding the base station 1112 and are serviced by the common base station. However, other arrangements are possible.

It is also to be understood by those skilled in the art that FIG. 15A may be a standard cellular type communication system such as CDMA, TDMA, GSM or other systems in which the radio channels are assigned to carry data and/or voice signals between the base station 1112 and the subscriber unit 1114. In a preferred embodiment, FIG. 15A is a CDMA-like system, using code division multiplexing principles such as those defined in U.S. Pat. No. 6,151,332.

The antenna apparatus 1110 includes a cylindrically shaped base or ground plane 1120 upon which are mounted the active antenna element 120 and five passive antenna elements 110/112. As illustrated, the antenna apparatus 1110 is coupled to the laptop computer 1114 (not drawn to scale). The antenna apparatus 1110 allows the laptop computer 1114 to perform wireless communications via forward link signals 1130 transmitted from the base station 1112 and reverse link signals 1132 transmitted to the base station 1112.

In the depicted embodiment, the antenna elements are disposed on the ground plane 1120 in the dispersed manner as illustrated in the figure. That is, the embodiment includes five passive antenna elements 110/112 which are asymmetrically spaced about the perimeter of the ground plane 1120, and the active antenna element positioned at a location corresponding to a center of the ground plane 1120.

Figure 16:
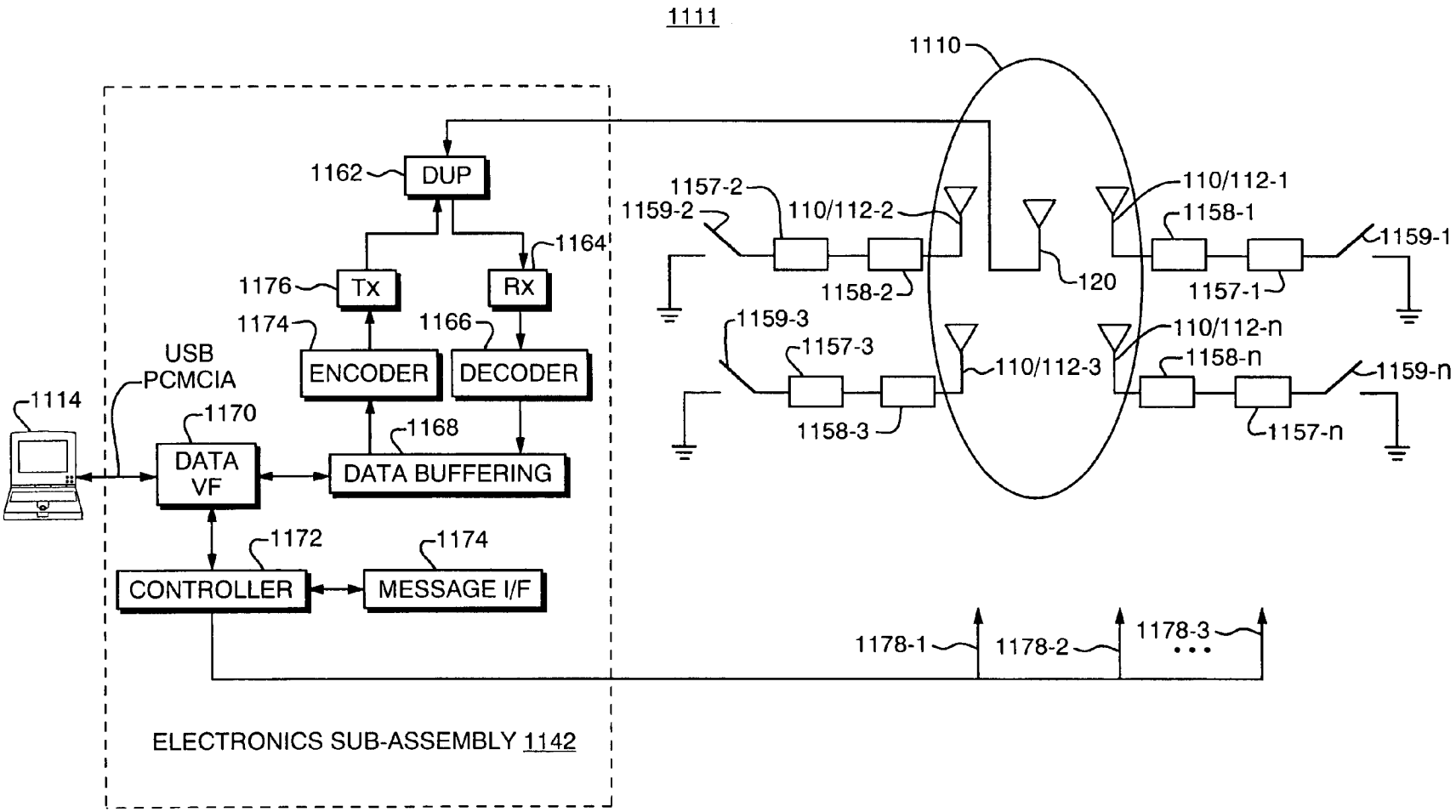
FIG. 16 is a system level diagram for the electronics used to control the antenna array of FIG. 15A.

Turning attention to FIG. 16, there is shown a block diagram of the electronics which control the subscriber access unit 1111. The subscriber access unit 1111 includes the antenna apparatus or array 1110, and an electronics sub-assembly 1142. The active antenna element 120 is connected, directly through a duplexer filter 1162, to the electronics sub-assembly 1142, while each of the passive antenna elements 110/112 is connected to a delay 1158, a variable or lumped impedance element 1157, and a switch 1159.

Wireless signals are communicated between the base station 1112 and the active antenna element 120. In turn, the active antenna element 120 provides the signals to the electronics sub-assembly 1142 or receives signals from the assembly 1142. The passive antenna elements 110/112 either reflect the signals or direct the signals to the active antenna element 120. As shown in FIG. 16, a controller 1172 may provide control signals 1178 to control the state of the delays 1158, impedance elements 1157, and switches 1159 of the passive antenna elements 110/112.

In the transmit direction, radio frequency signals provided by the electronic sub-assembly 1142 are fed directly to the active antenna element 120 which transmits the signals towards the base station 1112.

In the receive direction, the electronics sub-assembly 42 receives the radio signal from the active antenna element 120 at the duplexer filter 62 which provides the received signals to a radio receiver 1164. The radio receiver 1164 provides a demodulated signal to a decoder circuit 1166 that removes the modulation coding. For example, such decoder may operate to remove Code Division Multiple Access (CDMA) type encoding which may involve the use of pseudorandom codes and/or Walsh codes to separate the various signals intended for particular subscriber units, in a manner which is known in the art. The decoded signal is then fed to a data buffering circuit 1168 which then feeds the decoded signal to a data interface circuit 1170. The interface circuit 1170 may then provide the data signals to a typical computer interface such as may be provided by a Universal Serial Bus (USB), PCMCIA type interface, serial interface or other well-known computer interface that is compatible with the laptop computer 1114. The controller 1172 may receive and/or transmit messages from the data interface to and from a message interface circuit 1174 to control the operation of the decoder 1166, an encoder 1174, the tuning of the transmitter 1176 and receiver 1164.

Referring now to FIG. 15B, each passive antenna element 110/112 is mounted to the top of the ground plane 1120. A transmission feed line 1182 is connected to the passive antenna element 110/112 at a bottom feed point 1183, and to the delay line 1158 which in turn is connected to the variable or lumped impedance element 1157 and the switch 1159. The passive antenna element 110/112, and the transmission feed line 1182 are electrically isolated from the ground plane 1120. The delay line 1158, the lumped or variable impedance element 1157, and the switch 1159 are located within the ground plane 1120 but are also electrically isolated from the ground plane. The transmission line 1182 provides a path for control signals to the passive antenna element 110/112.

Located beneath each passive antenna element 110/112 is a resonant strip 1190 positioned in a slot 1192 formed in the ground plane 1120. The slot 1192 is slightly larger in size than the resonant strip 1190 to define a space 1194. A top end 1196 of the resonant strip 1190 is electrically coupled to the ground plane 1120. However, the space 1194 is filled with nonmetallic material, for example, PCB materials such as polystyrene or Teflon, to electrically isolate the non-top end portion 1198 of the resonant strip 1190 from the ground plane 1120.

Both the antenna element 110/112 and the respective resonant strip 1190 are made, for example, from copper. For applications in the PCS bandwidth (1850 Mhz to 1990 Mhz), the antenna element 110/112 has a length of about a quarter wavelength of the operating signal and a thickness of about one-tenth a wavelength. Each resonant strip 1190 is also about a quarter wavelength long and about one-tenth wavelength in thickness. The bottom of the resonant strip 190 is positioned at a height, "h," of about a one-eighth wavelength above the bottom of the ground plane 1120 (FIG. 15A), although the bottom of the resonant strip 1190 can be nearly touching the bottom of the ground plane 1120.

In use, signals are transmitted to and received from the active antenna element 120 to enable the antenna array 1110 to communicate with the base station 1112. The curved outer surface 1200 of the ground plane 1120 brings the beam formed by the antenna array 1110 down to the horizon since the surface normal of the curved surface 1200 points towards the horizon. Because of the presence of the resonant strip 1190, the passive antenna elements 110/112 couple with a respective resonant strip 1190 to form effectively an unbalanced dipole antenna. As such, the combination of the passive antenna element 110/112 and the resonant strip 1190 provide further capabilities to direct the array beam along the horizon so that the ground plane 1120 may be reduced in size without sacrificing the beam directing capability of the antenna array 1110. As essentially an array of unbalanced dipole antenna elements, the antenna array 1110 is capable of forming a beam with a peak beam strength which rises no more than about 10° above the horizon, or even less, for example, right no more than 0°.

In addition, the coupling of the passive antenna elements 110/112 with the resonant strips 1190 increases the effective area of the antenna and consequently the gain. And, since the antenna elements 110/112 are mounted on top of the ground plane 1120, the antenna array sensitivity to external environmental factors (such as when the array is placed on a metallic table) is decreased because the direct coupling of the antenna element 110/112 to these factors is minimized.

Figure 18A:
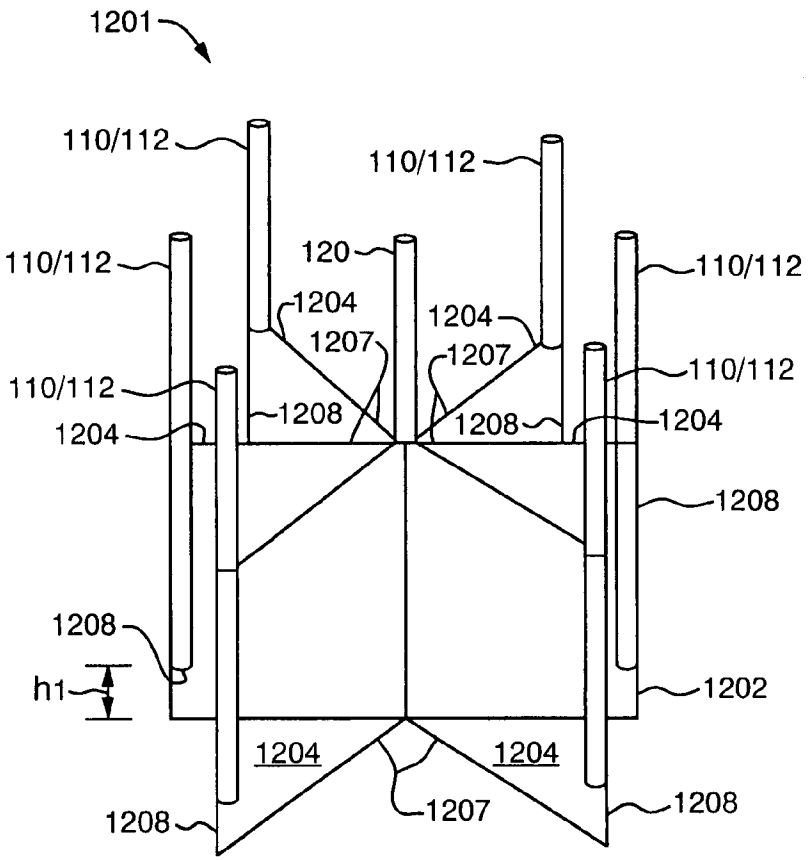
FIG. 18A is a perspective view of an alternative embodiment of an antenna array according to certain principles of the present invention.
Figure 19:
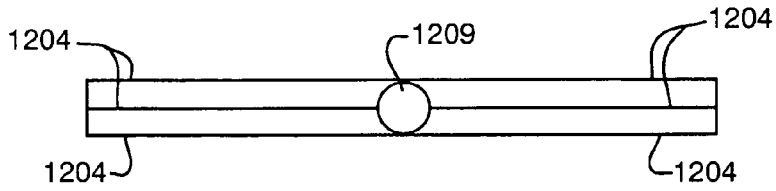
FIG. 19 is a view of the antenna array of FIG. 18A collapsed into a flat compact unit.

The antenna array can be implemented with non-cylindrical ground planes as well. For example, there is shown in FIG. 18A an antenna array 120 with a ground plane 1202 made of six plates 1204. Seven antenna elements are mounted on the ground plane 1202 in the manner illustrated in the figure. That is, the embodiment includes six passive director/reflector elements 110/112 which are spaced about the perimeter of the ground plane 1202 above an outer edge 1208 of each plate 1204, and a seventh active element 120 is positioned at a location corresponding to a center of the ground plane 1202. An inner edge 1207 of each plate 1204 is joined together with the other inner edges 1207 at the center of the ground plane 1202 to form a hinge 1209. The hinge 1209 can be spring loaded so that the plates 204 are collapsible to form a flat compact unit (FIG. 19), thereby making the antenna array convenient for transporting.

Figure 18B:
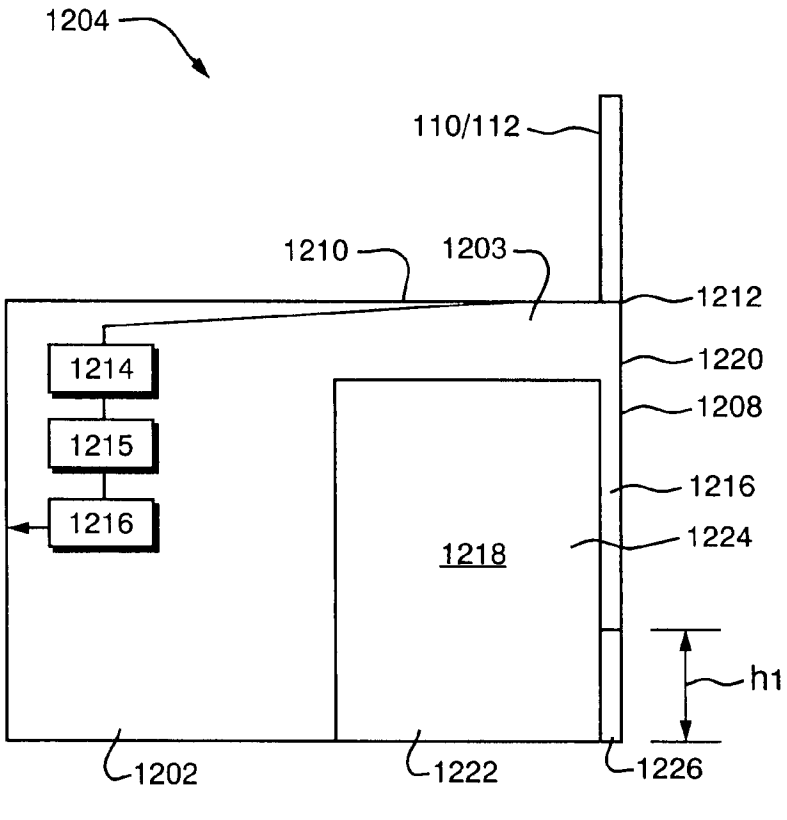
FIG. 18B is a close-up cutaway view of a passive antenna element of the antenna array of FIG. 18A.

Referring in particular to FIG. 18B, each antenna element 110/112 is mounted to the top of the ground plane 1202, but is electrically isolated from the ground plane 1202. The antenna element 110/112 is connected to a transmission feed line 1210 at a bottom feed point 1212. Each plate 1204 is provided with a delay line 1214 connected to a lumped or variable impedance element 1215 and a switch 1216 which are connected to the antenna element 110/112 through the transmission feed line 1210. The transmission feed line 1210, the delay line 1214, the lumped or variable element 215, and the switch 216 serve the same functions as the transmission feed line 1182, the delay line 1158, the lumped or variable impedance element 1157, and the switch 1159 for the embodiment described with reference to FIGS. 15A and 15B.

Each plate 1204 is also provided with a resonant strip 1216 positioned along the outer edge 1208 of the plate 1204. A top end 1220 of the resonant strip 1216 is electrically coupled to the ground plane 1202 by a top band 1203.

Each plate 1204 includes a nonmetallic dielectric substrate 1222 made from, for example, PCB materials such as polystyrene or Teflon. For PCS applications, the substrate has a height of about one-third the wavelength of the operating signal, and a width of about one-quarter wavelength and is about 0.03 inch thick. The ground plane 1202 and the resonant strip 1216 are produced with printed circuit board (PCB) techniques by depositing on one side 1218 of the substrate 1222 with copper having a thickness of about 0.0015 inch, and then photo-etching the copper into the desired shapes. Thus the ground plane 1202, the top band 1203 and the resonant strip 1216 form a continuous layer of copper surrounding an inner region 1224 of the substrate 1222. In addition, there is a thin region 1226 of height, "$h_1$," separating the bottom of the resonant strip 1216 from the bottom of the plate 1204. PCB techniques are also used to print the transmission feed line 1210, the delay line 1214, the lumped or variable impedance element 1215, and the switch 1216 on the opposite side of the substrate 1222. The antenna elements 110/112 and 120 are also typically made from copper. The antenna elements 110/112 and the resonant strips 216 are about one-quarter wavelength long, and are about a one-tenth wavelength wide.

Figure 20:
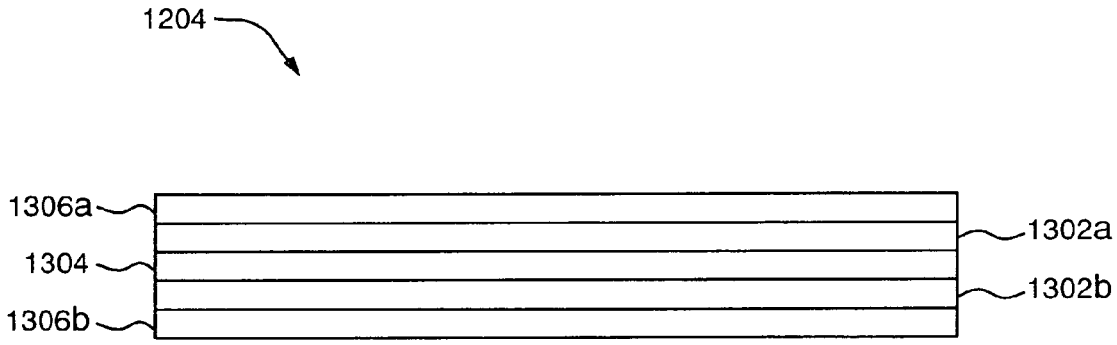
FIG. 20 is a side view of an alternative configuration of the multiple layers of a plate of antenna array.

Referring now to FIG. 20, there is shown an alternative lay-up for the plate 1204. Here, a conductive material 1304, for example, copper, is sandwiched between two substrates 1302A and 1302B made from a dielectric material. On the outer sides of the substrates 1302A and 1302B, there is a respective layer of conductive material 1306A and 1306B. The inner conductive material 1304 is used for transmission line activity for the antenna element 110/112, as well as the delay line 1214, the lumped or variable impedance element 1215, and the switch 1216 which are typically imbedded in one of the substrates 1302A or 1302B. The two outer layers of conductive material 1306A and 1306B serve as the ground plane 1202 and the resonant strip 1216.

The elements 110/112 shown in the embodiments of FIGS. 15A and 18A when implemented in practice, are preferably unequally spaced, and hence the beams formed from the antenna arrays 1110 or 1201 in various directions do not have necessarily the same shape.

Figure 21:
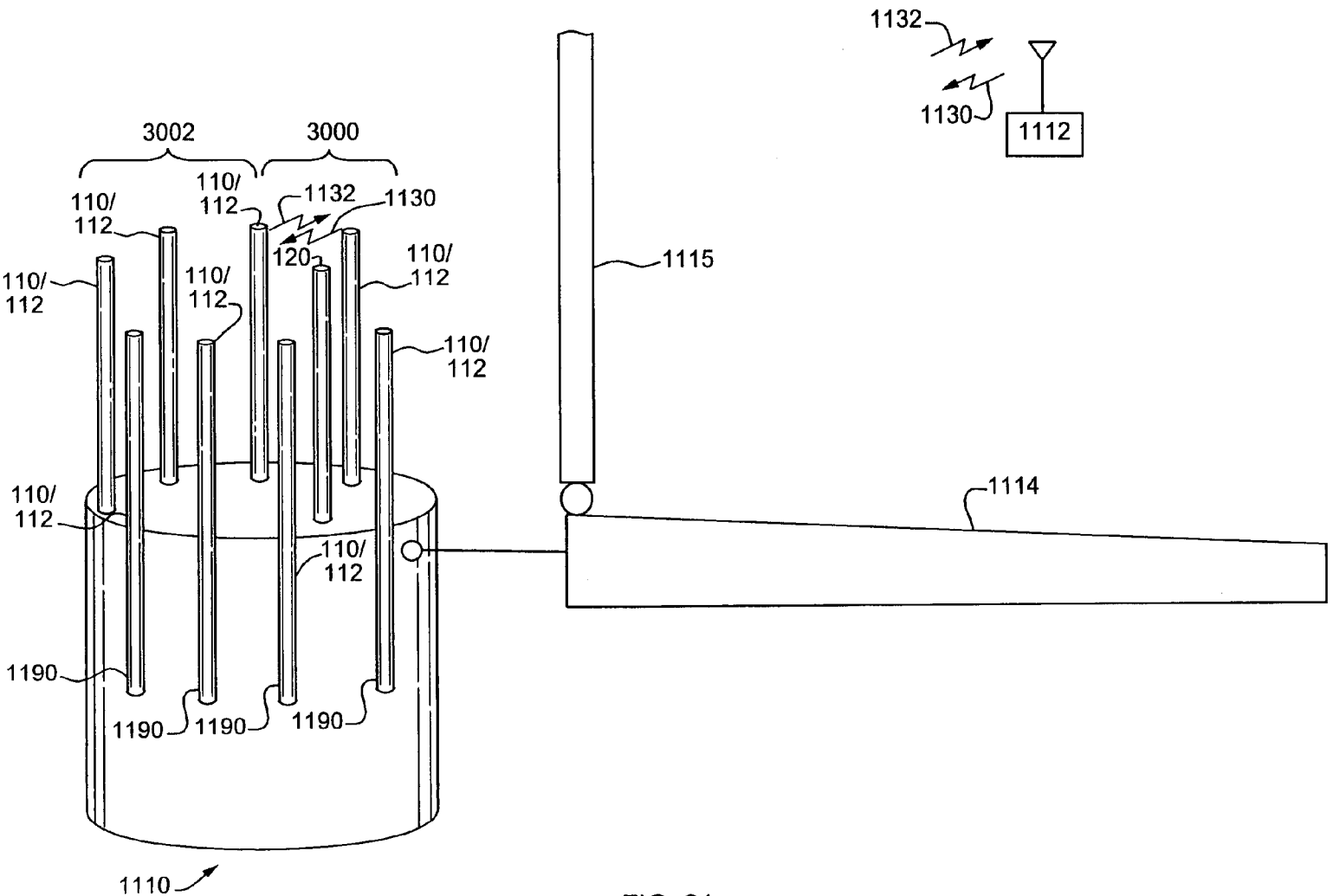
FIG. 21 is a perspective view of an antenna array with aperiodic spacing of passive antenna elements according to certain principles of the present invention.

In some situations, the antenna array 1110 or 1201 is physically blocked by a computer screen 1115 of the laptop computer 1114, as illustrated in FIG. 21, or the array could be blocked by some other object. These blocked regions 3000 of the antenna array require fewer antenna elements such that the spacing of the elements in these regions can be larger. Accordingly, the spacing of the elements on the opposite side 3002 of the array may be smaller. With more passive elements, or a higher element density, in a particular region of the array, the antenna array is able to cover a wider band in the direction of that region by being able to operate at higher frequencies without being affected by gain reducing grating lobes.

Unequal spacing, or aperiodic spacing, of the passive elements 110/112 of the arrays 1110 or 1201 also provides better performance when certain elements of the array are more closely spaced in a region 3002 of the array directed towards a geographic area having more communication terminals as depicted by the location of the base station 1112 in FIG. 21 relative to the antenna array 1110. By having the lower side lobe levels in a selected direction, the performance of the antenna array is increased.

Also recall, that in certain embodiments described above, in particular those in which each passive antenna elements 110 and 112 are connected to respective varactors, the antenna array provides virtually infinite phase shifting via the virtually infinite selectable impedance values of the varactors. As such, antenna arrays 1110 or 1201 with passive elements 110/112 connected to such varactors can provide directive beams in virtually any direction, for example, in one degree increments in 180 degrees of a circle. With such fine capability to tailor the radiation direction, making the antenna arrays 1110 or 1201 with unequally spaced passive elements, hence aperiodic, adds another dimension of control to the antenna array.

Note that the embodiments described above are shown merely for the purposes of illustration and not as limitations of the invention. For example, although the passive antenna elements 110/112 of the antenna arrays 1110 and 1201 as shown in FIGS. 15A and 18A, respectively, are associated with respective delay lines, impedance elements, and switches, the elements 110/112 can be operated with any of the other earlier described devices and procedures. In particular, each of elements 110/112 can be switched between the transmissive mode and the reflective mode with any of the techniques and devices described prior to the discussion of the antenna arrays 1110 and 1201.

While this invention has been particularly shown and described with references to preferred embodiments thereof, it will be understood by those skilled in the art that various changes in form and details may be made therein without departing from the scope of the invention encompassed by the appended claims.

The invention claimed is:

1. An antenna apparatus comprising:

an active antenna element;

at least two passive antenna elements individually selectable to operate in either a reflective mode or a transmissive mode; and a resonant strip positioned adjacent at least one respective passive antenna element, the resonant strip serving to increase gain of the antenna apparatus, the combination of the resonant strip and respective passive antenna element providing a dipole element.

2. The antenna apparatus of claim 1 wherein the apparatus provides a composite directed beam directed along a horizon.

3. The antenna apparatus of claim 2 wherein the directed beam rises above the horizon at an angle of from about 0° to 10°.

4. The antenna apparatus of claim 1 additionally comprising a ground plane disposed adjacent at least one of the antenna elements.

5. The antenna apparatus of claim 1 wherein the passive antenna elements are aperiodically spaced from the active antenna element.

6. An antenna apparatus comprising:

an active antenna element;

at least two passive antenna elements individually selectable to operate in either a reflective mode or a transmissive mode;

a resonant strip positioned adjacent at least one respective passive antenna element, the combination of the resonant strip and respective passive antenna element providing a dipole element; and a cylindrical ground plane disposed adjacent at least one of the antenna elements, wherein the top side of the ground plane is a planar end of the cylinder, and the bottom side of the ground plane is an opposite planar end of the cylinder.

7. An antenna apparatus comprising:

an active antenna element;

at least two passive antenna elements individually selectable to operate in either a reflective mode or a transmissive mode; and a resonant strip positioned adjacent at least one respective passive antenna element, wherein each resonant strip is disposed within a respective slot of a ground plane, the walls of each slot being spaced apart from the surface of the respective resonant strip, and the space between the walls and the surface being filled with nonmetallic material to electrically isolate a non-top end portion of the resonant strip from the ground plane, the combination of the resonant strip and respective passive antenna element providing a dipole element; and wherein the antenna apparatus provides a directed beam along a horizon.

8. An antenna apparatus comprising:

an active antenna element;

at least two passive antenna elements individually selectable to operate in either a reflective mode or a transmissive mode;

a resonant strip positioned adjacent at least one respective passive antenna element, the combination of the resonant strip and respective passive antenna element providing a dipole element; and a ground plane disposed adjacent at least one of the antenna elements, the ground plane is formed of two or more plates equal in number to the number of resonant strips.

9. The antenna apparatus of claim 8 wherein each plate has an outer edge and an inner edge, with the resonant strips being aligned along the outer edge of a respective plate, and the inner edges of the plates being joined together at the center of the ground plane forming a central joint with an axis that is substantially parallel to the axes of the resonant strips, the active antenna element being aligned along the axis of the central joint.

10. The antenna apparatus of claim 9 wherein the central joint is a hinge.

11. The antenna apparatus of claim 9 wherein each plate further comprises a first nonmetallic substrate and a first conductive material layered over one side of the first substrate, a conductive portion of the ground plane and the resonant strips being made of the first conductive material.

12. The antenna apparatus of claim 9 wherein each plate further comprises includes a second nonmetallic substrate, a second conductive material sandwiched between the first substrate layer and the second substrate layer, and a third conductive material layered on an opposite side of the second nonmetallic substrate, the conductive portion of the ground plane and the resonant strips being made of the first conductive material and the third conductive material, respectively.

13. An antenna apparatus comprising:

an active antenna element;

at least two passive antenna elements individually selectable to operate in either a reflective mode or a transmissive mode;

a resonant strip positioned adjacent at least one respective passive antenna element, the combination of the resonant strip and respective passive antenna element providing a dipole element; and the passive antenna elements are formed on one side of a printed circuit board, and the active antenna element is formed on another side of the printed circuit board.

14. The antenna apparatus of claim 13 additionally comprising:

a respective resonant shape positioned adjacent each passive element and located on the same side of the printed circuit board as the respective passive element.

15. The antenna apparatus of claim 13 additionally comprising:

a ground structure positioned adjacent the passive elements.

16. The antenna apparatus of claim 13 wherein the resonant shape balances the respective passive element.

* * * * *

UNITED STATES PATENT AND TRADEMARK OFFICE

CERTIFICATE OF CORRECTION

PATENT NO. : 7,176,844 B2
APPLICATION NO. : 11/102984
DATED : February 13, 2007
INVENTOR(S) : Chiang et al.

It is certified that error appears in the above-identified patent and that said Letters Patent is hereby corrected as shown below:

IN THE DRAWINGS

At FIG. 2, item 650, line 1, delete “TRANCEIVER” and insert therefor --TRANSCEIVER--.

At FIG. 5, item 650, line 1, delete “TRANCEIVER” and insert therefor --TRANSCEIVER--.

At column 1, line 5, after the words “continuation of”, insert --co-pending--.

At column 2, line 57, after the word “antenna”, delete “element” and insert therefor --elements--.

At column 5, line 47, before the word “unbalanced”, delete “provides a” and insert therefor --provide an--.

At column 5, line 58, after the words “can be”, delete “form” and insert therefor --formed--.

At column 8, line 9, before the word “insulating”, delete “a” and insert therefor --an--.

At column 8, line 9, after the word “table”, delete “upon”.

At column 8, line 10, before the word “which”, insert --upon--.

At column 8, line 26, before the word “application”, delete “a” and insert therefor --an--.

At column 8, line 54, before the words “of a”, delete “stats” and insert therefor --states--.

At column 9, line 13, before the words “input/output”, delete “in”.

At column 9, line 16, after the word “device”, insert --which--.

At column 9, line 20, before the word “opens”, delete “225” and insert therefor --235--.

At column 9, line 23, after the word “element”, delete “225” and insert therefor --120--.

At column 9, line 38, after the words “where the”, delete “antenna device 235”.

UNITED STATES PATENT AND TRADEMARK OFFICE

CERTIFICATE OF CORRECTION

PATENT NO. : 7,176,844 B2
APPLICATION NO. : 11/102984
DATED : February 13, 2007
INVENTOR(S) : Chiang et al.

It is certified that error appears in the above-identified patent and that said Letters Patent is hereby corrected as shown below:

At column 9, line 47, before the words "In such", delete "Ghz." and insert therefor --GHz.--.

At column 11, line 18, before the word "received", delete ". Respective" and insert therefor --, respective--.

At column 13, line 3, after the word "magnitude", delete "a part" and insert therefor --apart--.

At column 13, line 10, delete "110" and insert therefor --112--.

At column 13, line 62, before the word "along", delete "a symmetrical" and insert therefor --asymmetrical--.

At column 14, line 32, after "29", delete "db" and insert therefor --dB--.

At column 14, line 66, before the word "merely", delete "has" and insert therefor --was--.

At column 15, line 18, after the word "becomes", delete "an" and insert therefor --a--.

At column 15, line 27, after the word "respect", insert --to--.

At column 15, line 32, after the word "impedance", delete "during" and insert therefor --contributed by--.

At column 15, line 48, after the words "desired on", delete "opposites" and insert therefor --opposite--.

At column 15, line 53, before the words "of a circle", delete "arch" and insert therefor --arc--.

At column 15, line 54, before the words "with the", delete "arch" and insert therefor --arc--.

At column 15, line 55, after the words "of the", delete "arch" and insert therefor --arc--.

At column 17, line 48, after the word "bandwidth", delete "(1850 Mhz to 1990 Mhz)," and insert therefor --(1850 MHz to 1990 MHz),--.

At column 17, line 53, after the word "strip", delete "190" and insert therefor --1190--.

UNITED STATES PATENT AND TRADEMARK OFFICE

CERTIFICATE OF CORRECTION

PATENT NO. : 7,176,844 B2
APPLICATION NO. : 11/102984
DATED : February 13, 2007
INVENTOR(S) : Chiang et al.

It is certified that error appears in the above-identified patent and that said Letters Patent is hereby corrected as shown below:

At column 18, line 31, after the word "plates", delete "204" and insert therefor --1204--.

At column 18, line 44, before the word "serve", delete "215, and the switch 216" and insert therefor --1215, and the switch 1216--.

Signed and Sealed this

Twenty-first Day of August, 2007

JON W. DUDAS
*Director of the United States Patent and Trademark Office*